US009709073B2

(12) United States Patent
Otsuka et al.

(10) Patent No.: US 9,709,073 B2
(45) Date of Patent: Jul. 18, 2017

(54) CENTRIFUGAL FAN

(71) Applicant: MINEBEA CO., LTD., Kitasaku-Gun, Nagano (JP)

(72) Inventors: Takako Otsuka, Fukuroi (JP); Seiya Fujimoto, Fukuroi (JP); Takayuki Yamasaki, Fukuroi (JP); Masaki Ogushi, Fukuroi (JP)

(73) Assignee: Minebea Co., Ltd., Nagano (JP)

( * ) Notice: Subject to any disclaimer, the term of this patent is extended or adjusted under 35 U.S.C. 154(b) by 819 days.

(21) Appl. No.: 14/026,443

(22) Filed: Sep. 13, 2013

(65) Prior Publication Data

US 2014/0093366 A1 Apr. 3, 2014

(30) Foreign Application Priority Data

Oct. 3, 2012 (JP) ..... 2012-221462

(51) Int. Cl.
*F04D 29/66* (2006.01)
*F04D 29/28* (2006.01)
*F04D 29/30* (2006.01)

(52) U.S. Cl.
CPC ..... *F04D 29/666* (2013.01); *F04D 29/281* (2013.01); *F04D 29/30* (2013.01)

(58) Field of Classification Search
CPC ..... F04D 29/666; F04D 29/281; F04D 29/30; F04D 29/326; F04D 29/329;
(Continued)

(56) References Cited

U.S. PATENT DOCUMENTS 6,007,300 A * 12/1999 Saeki ..... F04D 29/283 416/178
6,755,615 B2 * 6/2004 Chapman ..... F04D 29/023 415/206
(Continued)

FOREIGN PATENT DOCUMENTS

JP S63-160400 U 10/1988
JP S64-19100 U 1/1989
(Continued)

OTHER PUBLICATIONS

Japanese Office Action issued on May 31, 2016 in corresponding Japanese Patent Application No. 2012-221462.

*Primary Examiner* — Craig Kim
*Assistant Examiner* — Brian P Wolcott
(74) *Attorney, Agent, or Firm* — Carrier Blackman & Associates, P.C.; Joseph P. Carrier; Jingli Wang

(57) ABSTRACT

A centrifugal fan includes an impeller, and a lower casing provided below the impeller. The impeller includes an upper shroud having an upper portion formed with an inlet, a lower shroud, and a plurality of blades arranged along a circumference direction between the upper shroud and the lower shroud. The blades extend from an inner side area to an outer side area in a radial direction, and are only connected to the lower shroud with the inner side area such that at least an outer circumferential side portion of each blade faces an upper surface of the lower casing. A surface of the lower casing, which faces the impeller, configures a portion of a wall surface which guides the fluid introduced from the inlet. A surface of each blade at a side of a leading edge portion is formed with a discontinuous portion having a step shape.

15 Claims, 24 Drawing Sheets

(58) Field of Classification Search
CPC . F04D 29/384; F04D 25/064; H05K 7/20136; H05K 7/20172
USPC ..... 361/678, 695; 416/181, 210 R
See application file for complete search history.

(56) References Cited

U.S. PATENT DOCUMENTS

| | | | | |
|---|---|---|---|---|
| 7,794,198 | B2 * | 9/2010 | Omori | F04D 29/30 415/119 |
| 2011/0038743 | A1 * | 2/2011 | Yen | F04D 29/282 417/410.1 |
| 2012/0045338 | A1 * | 2/2012 | Tadokoro | F04D 29/30 416/196 R |
| 2013/0052049 | A1 * | 2/2013 | Fujimoto | F04D 17/16 417/321 |
| 2013/0058783 | A1 * | 3/2013 | Fukuda | F04D 25/0613 415/227 |
| 2013/0101405 | A1 * | 4/2013 | Shiraichi | F04D 29/283 415/191 |

FOREIGN PATENT DOCUMENTS

| | | | |
|---|---|---|---|
| JP | H5-12692 | U | 2/1993 |
| JP | H06257595 | A | 9/1994 |
| JP | H09100797 | A | 4/1997 |
| JP | 2001263295 | A | 9/2001 |
| JP | 2006-009577 | A | 1/2006 |
| WO | S62225799 | A | 10/1987 |

* cited by examiner

CENTRIFUGAL FAN

BACKGROUND OF THE INVENTION

1. Field of the Invention

The present invention relates to a centrifugal fan, and particularly, to a thin high-power centrifugal fan.

2. Description of the Related Art

FIG. 23 is a perspective view illustrating an example of a related-art centrifugal fan. FIG. 24 is a sectional side view illustrating the example of the related-art centrifugal fan.

As shown in FIGS. 23 and 24, a centrifugal fan 801 is generally configured by installing an impeller 830 in a casing 810 having an inlet 813 (833) and an outlet 819. The impeller 830 includes a plurality of blades 851 arranged around a rotating shaft of a motor 860. The centrifugal fan 801 suctions air from the inlet 813 (833), makes the air flow through the blades (wings) from the center of the impeller 830, and expels the air outward in the radial direction of the impeller 830 by a fluid force due to a centrifugal action according to rotation of the impeller 830. The air expelled outward from the outer circumference of the impeller 830 is discharged from the outlet 819 of the casing 810.

As shown in FIG. 24, the centrifugal fan 801 is thin. The centrifugal fan 801 has the motor 860 provided at the substantially center portion of the casing 810 in order for rotating the impeller 830. The motor 860 is an outer rotor type brushless motor disposed such that its rotor yoke 863 is fit in the impeller 830.

This centrifugal fan 801 is widely used for cooling, ventilation, and air-conditioning of appliances, office automation equipment, and industrial equipment, blowers for vehicles, etc. The blowing performance and noise of the centrifugal fan 801 are greatly affected by the wing (blade) shape of the impeller 830 and the shape of the casing 810 (the structure of the centrifugal fan 801).

Incidentally, in order to reduce noise or to improve blowing performance, it has been performed to optimize the shapes of impellers or the structures of casings, and various proposals have been made.

For example, JP-A-UM-H5-12692 discloses a turbo fan in which lengthwise recesses or circular recesses are formed on the pressure surface sides of blades, such that fan efficiency is improved.

JP-A-UM-S64-19100 discloses a multi-blade fan in which grooves are formed in the longitudinal directions of blades on the positive pressure surface sides of the blades, such that blade efficiency is improved.

JP-A-2006-9577 discloses a multi-blade fan in which stepped parts are formed such that the thickness of each blade decreases from the leading edge toward the trailing edge, whereby the noise of an impeller is reduced.

JP-A-UM-S63-160400 discloses a sirocco fan in which unevenness is formed on the upstream side of the pressure surface side of each blade, such that the operating efficiency of the main body of the fan is improved and noise is reduced.

With the progress of size reduction, thickness reduction, high-density mounting, and energy-saving of various apparatuses, it has been always required to improve the efficiency of a centrifugal fan to be mounted on those apparatuses.

At the same time, it has been always required to further reduce the level of noise generated by driving of a centrifugal fan.

SUMMARY OF THE INVENTION

The present invention has been made in view of the above circumstances, and an object of the present invention is to provide a centrifugal fan which is thin and highly efficient and is capable of reducing generation of noise.

According to an illustrative embodiment of the present invention, there is provided a centrifugal fan including an impeller rotatable about a rotation axis, and a lower casing which is provided below the impeller. The impeller includes an upper shroud having an upper portion formed with an inlet, a lower shroud, and a plurality of blades arranged along a circumference direction between the upper shroud and the lower shroud. A fluid introduced from the inlet is discharged to a side of the impeller according to rotation of the impeller. The blades extend from an inner side area to an outer side area in a radial direction, and the blades are only connected to the lower shroud with the inner side area of the blades such that at least an outer circumferential side portion of each blade faces an upper surface of the lower casing. A surface of the lower casing, which faces the impeller, configures a portion of a wall surface which guides the fluid introduced from the inlet. A surface of each blade at a side of a leading edge portion is formed with a discontinuous portion having a step shape.

In the above centrifugal fan, the discontinuous portion may be formed on at least one of a pressure surface and a negative pressure surface of each blade.

In the above centrifugal fan, the step shape of the discontinuous portion may be formed along a direction substantially parallel to the rotation axis.

In the above centrifugal fan, the discontinuous portion may include at least one of one or more step shapes and one or more groove shapes.

In the above centrifugal fan, the discontinuous portion may be formed within a range extending in a radial direction perpendicular to the rotation axis between the leading edge portion and a predetermined distance outward of the leading edge portion in the radial direction, and the predetermined distance may be 40% of a distance from the leading edge portion to a trailing edge portion of each blade in the radial direction.

In the centrifugal fan, each blade may have a shape which becomes thinner as increasing a distance from the upper shroud in a direction parallel to the rotation axis of the impeller.

In the above centrifugal fan, each blade may have a tapered shape such that a pressure surface thereof approaches a negative pressure surface thereof as increasing distance from the upper shroud in a direction parallel to the rotation axis of the impeller.

In the above centrifugal fan, as seen from a direction in which the rotation axis of the impeller extends, a pressure surface of each blade may have a shape in which at least three arcs are connected, or a shape expressed by a combination of a plurality of high-dimensional functions passing three points.

The above centrifugal fan may further include a motor which is attached to the lower shroud and configured to rotate the impeller to introduce the fluid from the inlet and discharge the fluid to the side of the impeller.

According to the above configuration, in the surface at the side of the leading edge portion of each blade, the discontinuous portion is formed in a step shape. Therefore, a centrifugal fan which is thin and highly efficient and is capable of reducing generation of noise can be provided.

DETAILED DESCRIPTION

Hereinafter, a centrifugal fan according to an illustrative embodiment of the present invention will be described.

[Description of Overall Structure of Centrifugal Fan]

Figure 1:
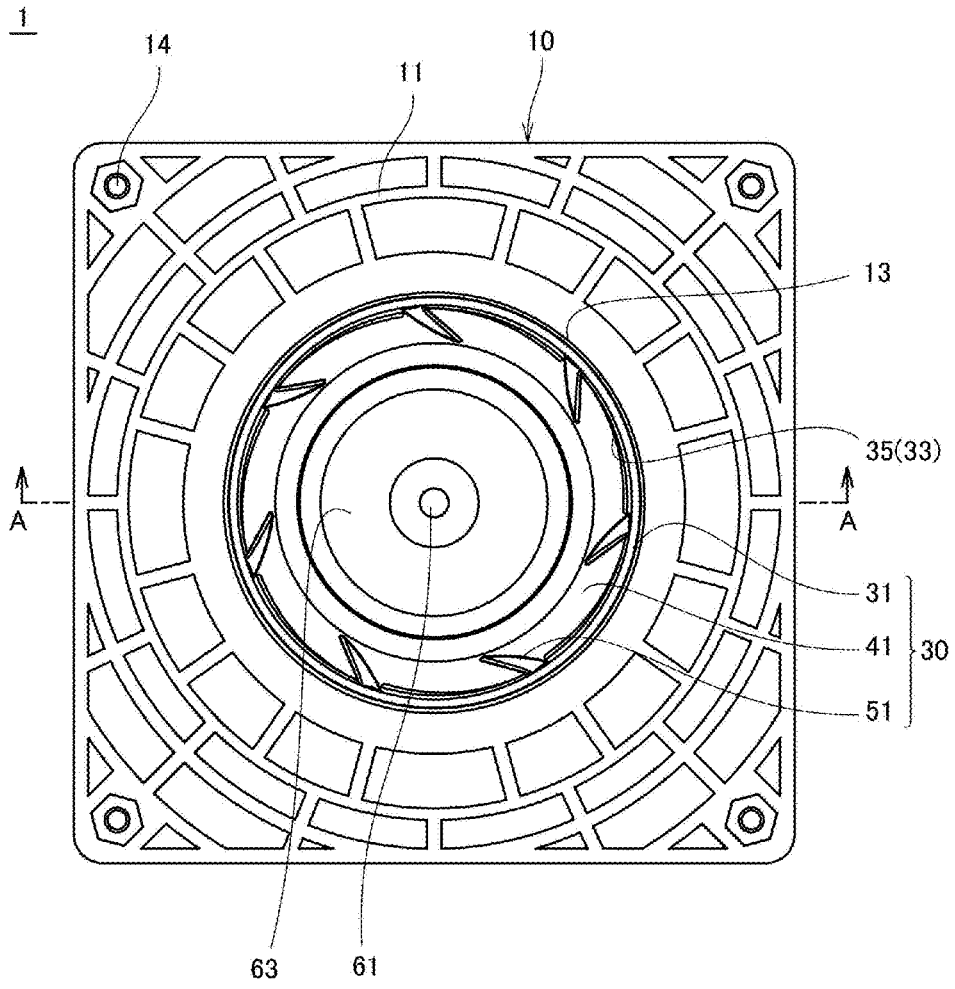
FIG. 1 is a plan view illustrating a centrifugal fan according to an illustrative embodiment of the present invention.
Figure 2:
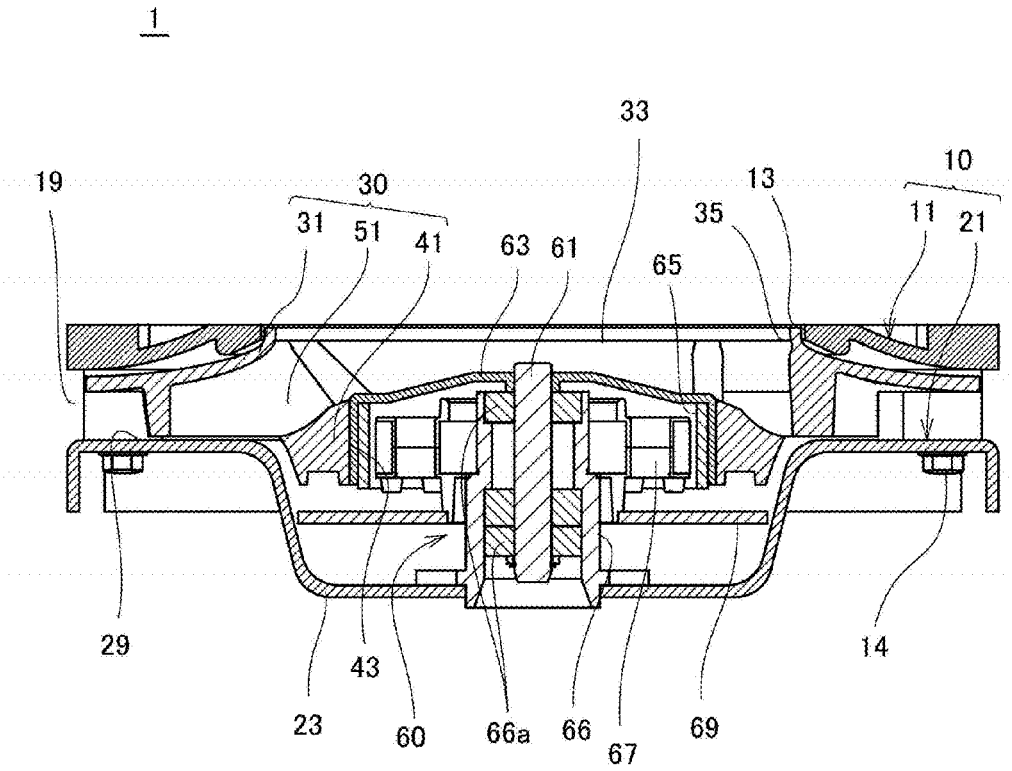
FIG. 2 is a cross-sectional view taken along the line A-A of FIG. 1.
Figure 3:
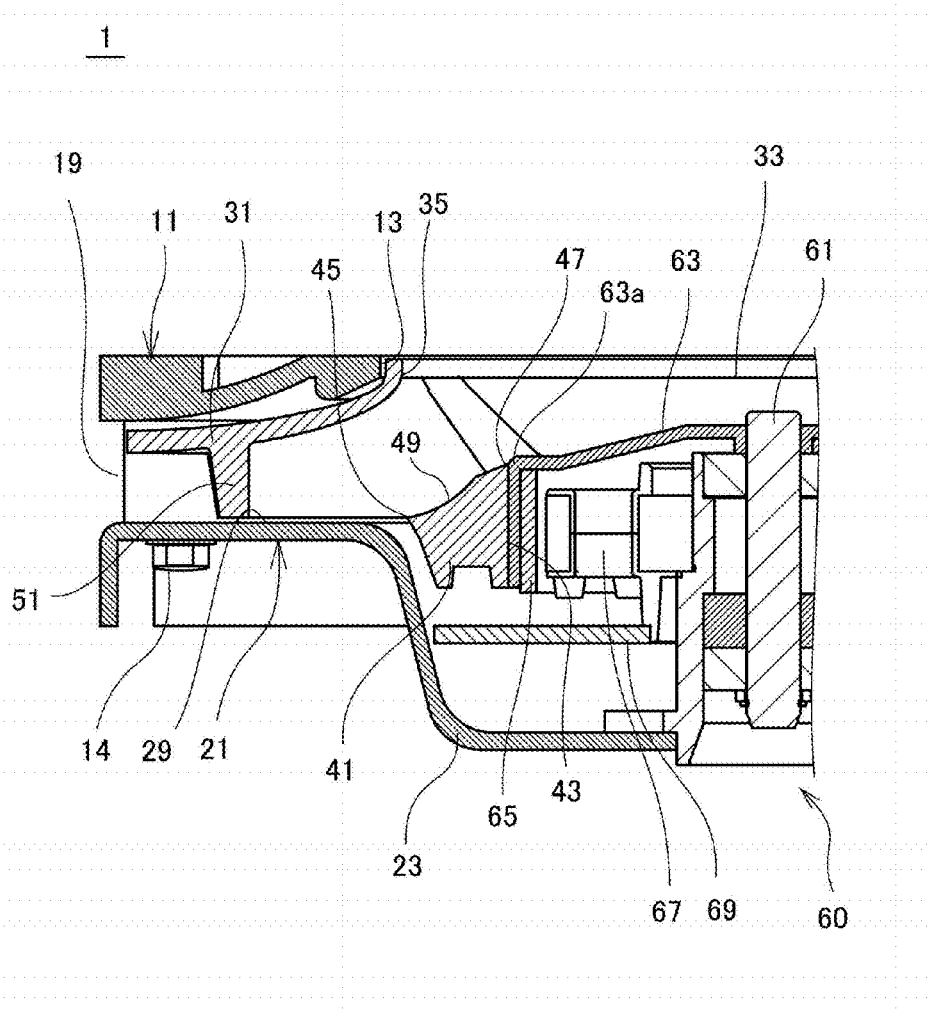
FIG. 3 is a partial enlarged view of FIG. 2.

FIG. 1 is a plan view illustrating a centrifugal fan according to an illustrative embodiment of the present invention. FIG. 2 is a cross-sectional view taken along the line A-A of FIG. 1. FIG. 3 is a partial enlarged view of FIG. 2.

Referring to FIGS. 1 to 3, a centrifugal fan 1 includes a casing 10, an impeller 30, and a motor 60. Except for a portion where the motor 60 is fit, the centrifugal fan 1 is generally configured in a cuboid shape which is substantially square as seen in a plan view. The centrifugal fan 1 is a thin fan whose dimension in a vertical direction (height) is comparatively small. The impeller 30 is mounted on a rotor 63 which rotates together with a shaft 61 of the motor 60. The centrifugal fan 1 rotates the impeller 30 by the motor 60. The centrifugal fan 1 discharges an air (an example of a fluid) introduced from an inlet 33 to the side of the impeller 30 by rotation of the impeller 30. That is, the air introduced from the inlet 33 passes through blades 51 of the impeller 30 and is expelled outward in the radial direction of the impeller 30 by a fluid force due to a centrifugal action according to the rotation of the impeller 30. The air is discharged from outlets 19 of the casing 10 which are at the side of the impeller 30.

The motor 60 is, for example, an outer rotor type brushless motor. The motor 60 is mounted at the center portion of a lower casing 21 by fastening members such as screws, bolts, and the like. The motor 60 has the rotor 63 which has a cup shape, and the rotor 63 is open toward a lower side. On the inner surface of a side peripheral portion of the rotor 63, an annular magnet 65 is mounted. The shaft 61 is fit into the center portion of the rotor 63.

The shaft 61 is rotatably supported by a pair of bearings 66*a* disposed in a bearing holder 66. On an outer circumferential portion of the bearing holder 66, a stator 67 is mounted. The stator 67 includes stacked stator cores, an insulator formed by winding a coil and mounted on the state cores, and so on. The stator 67 is disposed to face the magnet 65 with a predetermined gap in a radial direction (in a left-right direction in FIG. 2). The stator 67 is connected to a circuit board 69. The circuit board 69 is, for example, a printed circuit board. On the circuit board 69, various components such as an electronic component for controlling the motor 60 is mounted, and a drive circuit for the motor 60 is mounted.

The casing 10 is configured by assembling an upper casing 11 and a lower casing 21. Specifically, the upper casing 11 and the lower casing 21 are assembled with each other by fastening screws 14 which are positioned at four corners as seen in a plan view, whereby the casing 10 is configured. The screws 14 are, for example, bolts which are fit from a side of the lower casing 21. The upper casing 11 and the lower casing 21 are assembled with each other, for example, with supports interposed therebetween at the portions where the screws 14 are arranged. In this case, the supports may be configured integrally with either one of the upper casing 11 and the lower casing 21. The outlets 19 may be formed between the upper casing 11 and the lower casing 21, for example, at side portions of the casing 10 except for the fastening portions of the upper casing 11 and the lower casing 21 using the screws 14.

The impeller 30 is disposed to be accommodated in the casing 10. Above the impeller 30, the upper casing 11 is disposed, and below the impeller 30, the lower casing 21 is disposed. That is, the centrifugal fan 1 is configured by holding the impeller 30 between the upper casing 11 and the lower casing 21.

The impeller 30 includes an upper shroud 31, a lower shroud 41, and a plurality of blades 51 disposed between the upper shroud 31 and the lower shroud 41. At the center portion of the impeller 30, the inlet 33 is formed to be open toward the upper side. The inlet 33 is formed to be surrounded by an upper end portion 35 of the upper shroud 31 on the inner side. The plurality of blades 51 are arranged at appropriate intervals on a circumference direction.

The individual blades 51 have the same curved shape. That is, each blade 51 has a shape inclined backward with respect to a rotation direction. In FIGS. 1 to 3, the shapes of the blades 51 are simply shown. The specific shapes of the blades 51 will be described below. The upper shroud 31, the lower shroud 41, and the blades 51 may be formed by integral molding using, for example, synthetic resins.

At the center portion of the impeller 30, there is disposed the lower shroud 41 into which the rotor 63 is fit. At the center portion of the lower shroud 41, a cylindrical portion 43 is formed to allow the rotor 63 to be disposed therein.

The rotor 63 is fit into the cylindrical portion 43 formed at the center portion of the lower shroud 41, thereby holding the impeller 30. The rotor 63 is disposed inside the inlet 33 to protrude upward toward the outside of the inlet 33. Also, in order to prevent air which is suctioned from the inlet 33 from being blocked by the rotor 63 while making the centrifugal fan 1 comparatively thin, the vertical height of the portion of the rotor 63 holding the cylindrical portion 43 is set to be comparatively low.

The upper casing 11 is made of, for example, a resin such as engineering plastic. At the center portion of the upper casing 11, an opening 13 is formed. The opening 13 is circular as seen in a plan view. The opening 13 is formed such that air is introduced into the inlet 33 of the impeller 30. The opening 13 has an inside diameter slightly larger than that of the inlet 33 formed in the upper shroud 31. That is, in the present illustrative embodiment, the size of the opening 13 is substantially the same as the size of the inlet 33.

The lower casing 21 is made of, for example, a plate of a metal such as iron. At the center portion of the lower casing 21, a recess 23 is formed downward. The recess 23 is formed in a bowl shape. As shown in FIG. 2, in the present illustrative embodiment, in the recess 23, the motor 60, and the drive circuit for the motor 60 such as the circuit board 69 are installed. The motor 60 is mounted on the lower casing 21 by fastening members such as screws and bolts; however, the motor 60 may be mounted on the lower casing 21 by fixing the lower portion of the bearing holder 66 into the recess 23, instead of using the fastening members.

The outer circumferential portion of the lower casing 21 has a side plate bent in an axial direction (in an upper-lower direction of FIG. 2). The rigidity of the lower casing 21 can be improved by providing the side plate.

In the upper surface of the lower casing 21, a portion around the recess 23 is a partition portion 29 facing the lower surface of the impeller 30. The partition portion 29 is formed in a flat plate shape to be close to the lower surface of the impeller 30.

As shown in FIG. 2, the lower shroud 41 of the impeller 30 is provided only on a portion of the blades 51 at a side of the shaft (the rotation axis of the impeller 30) 61 such that at least an outer circumferential side portion of each blade 51 faces the partition portion 29. That is, the blades 51 are exposed at a portion of the impeller 30 facing the partition portion 29. A surface of the lower casing 21, which faces the impeller 30, configures a portion of a wall surface which guides air introduced from the inlet 33 to the side. The blades 51 are disposed to face the partition portion 29 with a predetermined gap in an axial direction. Incidentally, the lower portion of each blade 51 may be partially or wholly exposed to the partition portion 29.

As shown in FIG. 3, a portion of the upper surface of the lower shroud 41 has a curved surface 49 which forms a curved line having an arc shape convex downward in a lateral cross section. An outer circumferential end portion 45 of the lower shroud 41 is positioned in the vicinity of the vertically lower side of an upper end portion 35 of the upper shroud 31. Also, an inner circumferential end portion 47 of the lower shroud 41 is positioned in the vicinity of an upper end portion 63*a* of the outer periphery of the rotor 63. The curved surface 49 is formed between the outer circumferential end portion 45 and the inner circumferential end portion 47. The lowermost portion of the curved surface 49 is the outer circumferential end portion 45.

The dimension of the outside diameter of the impeller 30 which is accommodated in the casing 10 is set to be smaller than the dimension of one side of the casing 10. Therefore, the impeller 30 does not protrude from the outer edge of the casing 10 when rotating, and thus contact of the impeller 30 with other members, damages due to contact, and the like can be reduced or prevented.

The lower casing 21 serves not only as a main plate for guiding air in the impeller 30, but also the substrate of the casing 10. For this reason, setting of the gap which is formed between the impeller 30 and the partition portion 29 may be important. In a case where the gap is excessively large, air suctioned from the inlet 33 flows even into the gap while passing through the blades 51. As a result, the pressure of air expelled from the impeller is reduced, and thus a blowing characteristic is reduced. Meanwhile, in a case where the gap is excessively small, there is the following problem. That is, if a variation occurs in the accuracy of the dimensions of each component, there is a possibility that the blades 51 will come into contact with the partition portion 29. In order to prevent this contact, it is necessary to manage the accuracy of the dimensions of each component with a high degree of accuracy, and thus the manufacturing cost of the centrifugal fan 1 increases. In view of those problems, the gap between the impeller 30 and the partition portion 29 is appropriately set.

[Description of Structure of Impeller 30]

Subsequently, the structure of the impeller 30 will be described in more detail.

Figure 4:
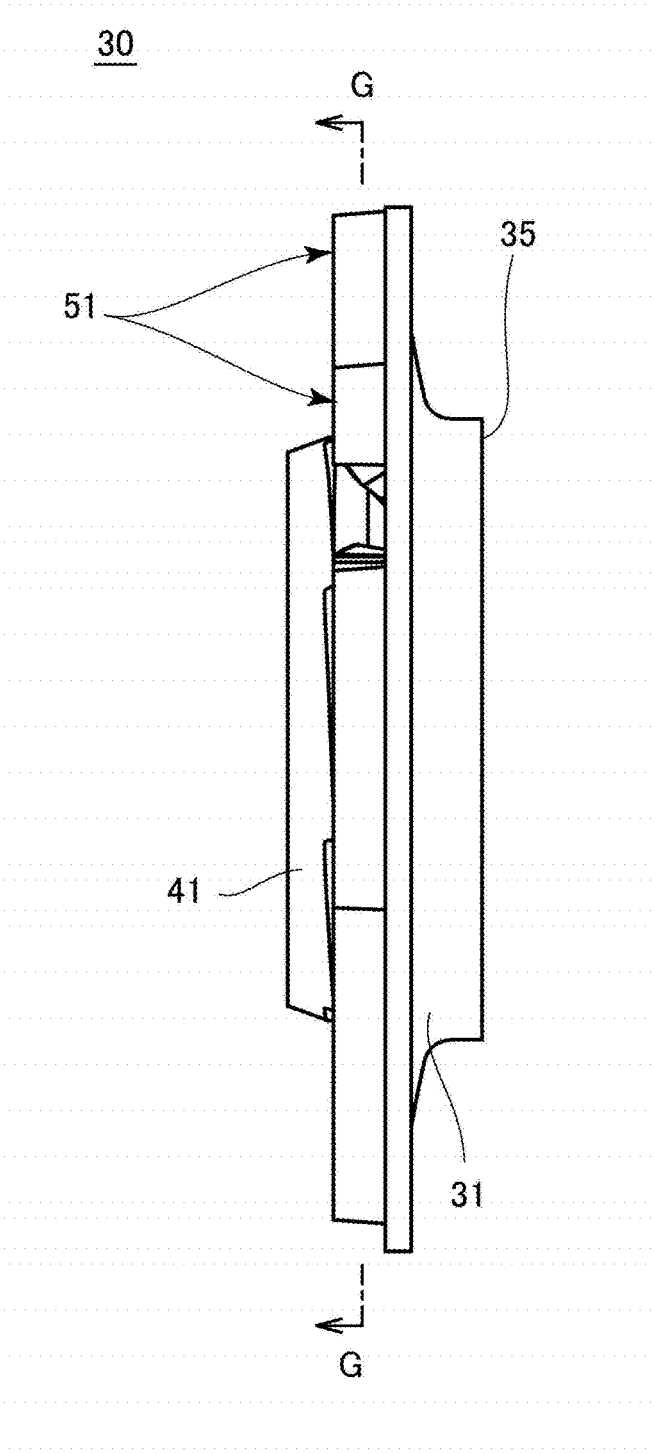
FIG. 4 is a side vide of an impeller.
Figure 5:
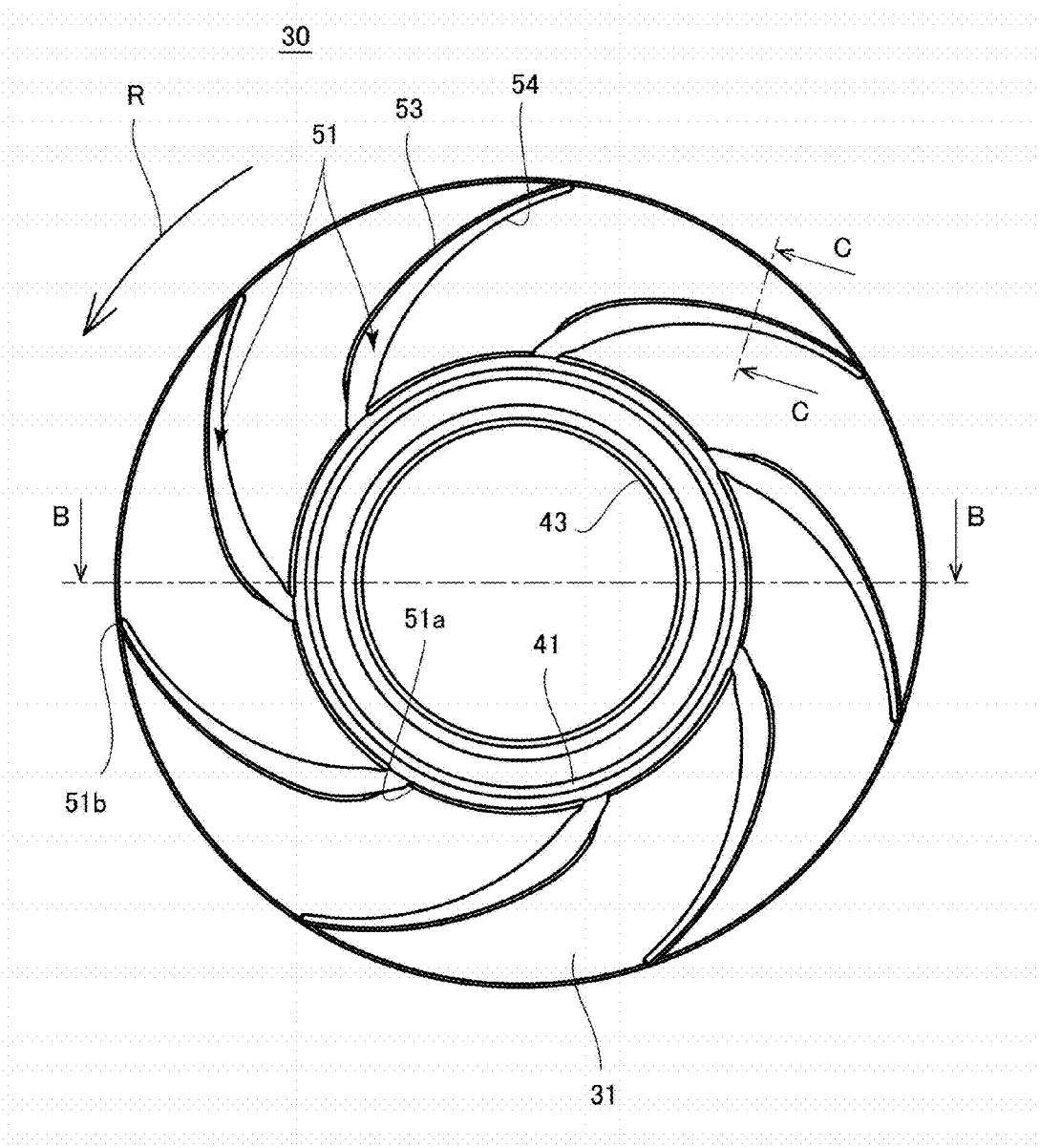
FIG. 5 is a bottom view of the impeller.
Figure 6:
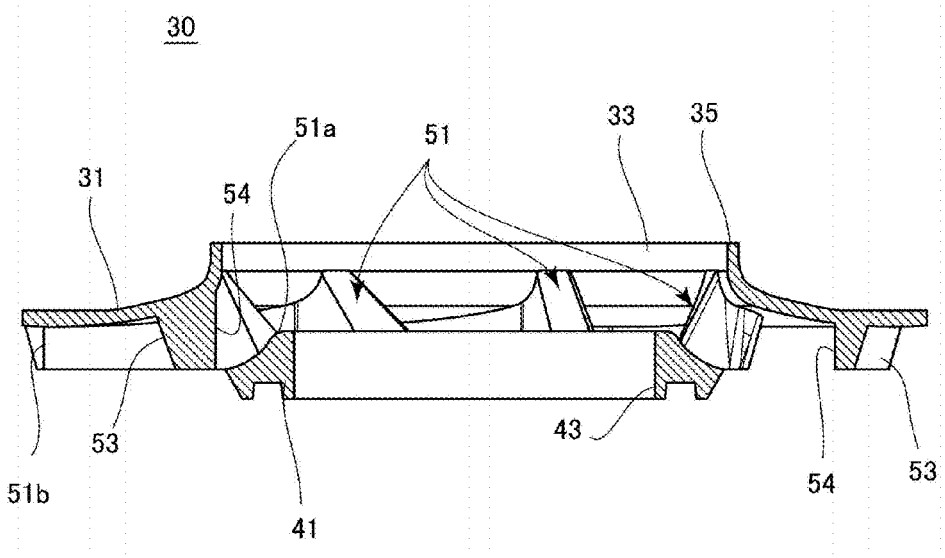
FIG. 6 is a cross-sectional view taken along the line B-B of FIG. 5.

FIG. 4 is a side vide of the impeller 30. FIG. 5 is a bottom view of the impeller 30. FIG. 6 is a cross-sectional view taken along the line B-B of FIG. 5.

Referring to FIGS. 4 to 6, the impeller 30 is a thin impeller which is roughly a disk shape. Therefore, the centrifugal fan 1 can be configured to be thin. As shown in FIG. 5, in the impeller 30, for example, seven blades 51 are arranged. Each blade 51 has a pressure surface 53 and a negative pressure surface 54. The pressure surface 53 is directed to a leading side of the impeller 30 in the rotation direction (a counter-clockwise direction, that is, a direction shown by an arrow R in FIG. 5). The negative pressure surface 54 is directed to the opposite side to the pressure surface 53.

Figure 7:
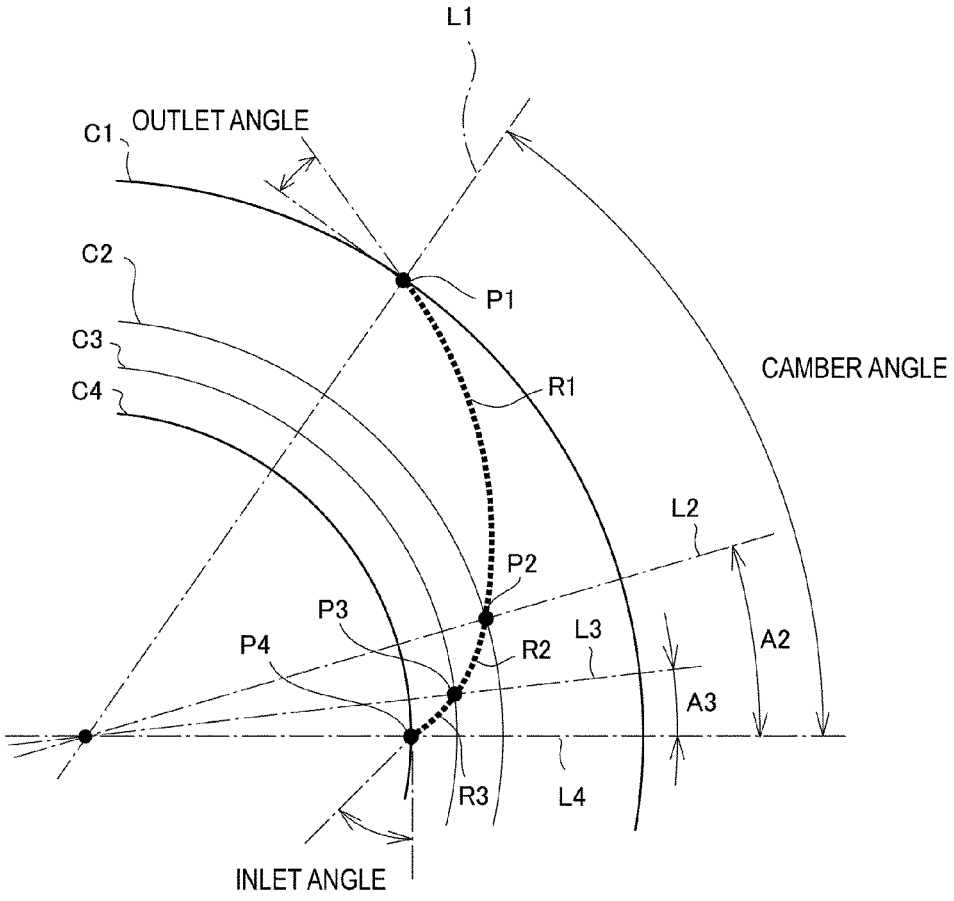
FIG. 7 is a view illustrating a shape of a pressure surface of a blade.

The blades 51 are backward inclined blades, and are of a so-called turbo type. The blades 51 have a blade shape inclined backward with respect to the rotation direction. The specific shape of each blade 51 is, for example, as follows. That is, as shown in FIG. 7 to be described below, as the pressure surface 53 is seen from a direction in which the rotation axis of the impeller 30 extends, the pressure surface 53 has roughly a shape in which three arcs are connected. These arcs are connected such that neighboring arcs are tangent to each other.

An edge of each blade 51 on the rotation axis side of the impeller 30, that is, a side of the inlet 33 becomes a leading edge, and an edge of each blade 51 on the side peripheral surface side of the impeller 30 becomes a trailing edge. As shown in FIG. 6, the leading edge of each blade 51 is configured in a tapered shape such that the leading edge becomes closer to the rotation axis of the impeller 30 as it approaches the lower shroud 41 from the upper shroud 31. The leading edge of each blade 51 and the lower shroud 41 are connected at a leading edge portion 51*a*. The trailing edge of each blade 51 has a shape substantially perpendicular to the rotation axis of the impeller 30 (a trailing edge portion 51*b*).

FIG. 7 is a view illustrating the shape of the pressure surface 53 of the blade 51.

In the present illustrative embodiment, the inlet angle, outlet angle, and camber angle of each blade 51 are set to about 45°, about 30°, and about 55°, respectively. However, the inlet angle, outlet angle, and camber angle of each blade 51 are not limited to those values. Herein, the term "inlet angle" refers to an angle which is formed by a tangent line of an inner circumferential edge (a circle having the rotation axis of the impeller 30 as its center and having a circumference on which the leading edge of the blade 51 as seen in a bottom view) and a tangent line of a curved line indicating the pressure surface 53 and shown in FIG. 7 at a point where the inner circumferential edge and the curved line indicating the pressure surface 53 are in contact with each other, and is 90° or less. The term "outlet angle" refers to an angle which is formed by a tangent line of an outer circumferential edge (a circle having the rotation axis of the impeller 30 as its center and having a circumference on which the trailing edge of the blade 51 as seen in a bottom view) and a tangent line of the curved line indicating the pressure surface 53 at a point where the outer circumferential edge and the curved line indicating the pressure surface 53 are in contact with each other, and is 90° or less. The term "camber angle" is an angle which is formed by a line connecting the leading edge of a blade 51 and the rotation axis of the impeller 30, and a line connecting the trailing edge of the corresponding blade 51 and the rotation axis as seen in a bottom view.

The shape of each pressure surface 53 is determined, for example, as follows. That is, the sizes of the inner circumferential edge and the outer circumferential edge are determined according to design specifications, the size of the motor, and so on. In view of the design specifications and reducing the level of noise such as NZ sound, the inlet angle, the outlet angle, and the camber angle are determined. Therefore, as seen in the bottom view, first to fourth points which the pressure surface 53 passes are determined. That is, as shown in FIG. 7, a first point P1 indicates the position of the trailing edge, and becomes the vertex of the outlet angle. A fourth point P4 indicates the position of the leading edge, and becomes the vertex of the inlet angle. A second point P2 is the intersection of a first circle C2 which is concentric with a circle C1 indicating the outer circumferential edge and has a size of ¾ of the size of the circle C1, and a straight line L2 that forms an angle A2 of 3/10 of the camber angle with respect to a straight line L4 extending from the rotation axis to the fourth point P4. A third point P3 is the intersection of a second circle C3 that is concentric with the first circle C2 and is positioned between the first circle C2 and a circle C4 indicating the inner circumferential edge, and the straight line L4 that forms an angle A3 of 3/20 of the camber angle with respect to the straight line L4. Further, the first point P1 and the second point P2, the second point P2 and the third point P3, and the third point P3 and the fourth point P4 are connected by arcs R1, R2, and R3, respectively. In this case, the three arcs R1, R2, and R3 are drawn such that the inlet angle and the outlet angle become predetermined angles, two arcs R1 and R2 connected to each other have a tangent relation (a relation in which the tangent lines of the two arcs at the contact point of the two arcs overlap each other), and two arcs R2 and R3 connected to each other have a tangent relation. In this way, the shape of each pressure surface 53 is determined.

The negative pressure surface 54 has roughly a curved shape following the pressure surface 53 as seen in a bottom view such that a distance from the pressure surface 53 is reduced as increasing a distance from the rotation axis of the impeller 30. Therefore, each blade 51 has a wing-like outer shape.

As the pressure surface 53 is seen from the direction in which the rotation axis of the impeller 30 extends, the pressure surface 53 may have a shape expressed by combining a plurality of high-dimensional functions passing three points.

That is, in the present illustrative embodiment, the shape of the pressure surface 53 of each blade 51 is formed by three arcs as seen in the bottom view. Therefore, the flow and static pressure of the centrifugal fan can be improved and noise of the centrifugal fan can be reduced.

In the present illustrative embodiment, the thickness of each blade 51, that is, the distance between the pressure surface 53 and negative pressure surface 54 of each blade 51 is reduced as increasing a distance from the upper shroud 31 in a direction parallel to the rotation axis. In other words, each blade 51 is formed to become thinner as it approaches the partition portion 29. Therefore, the distance between the pressure surface 53 of a blade 51 and the negative pressure surface 54 of another blade 51 next to the corresponding blade 51 increases as they approach the partition portion 29.

Figure 8:
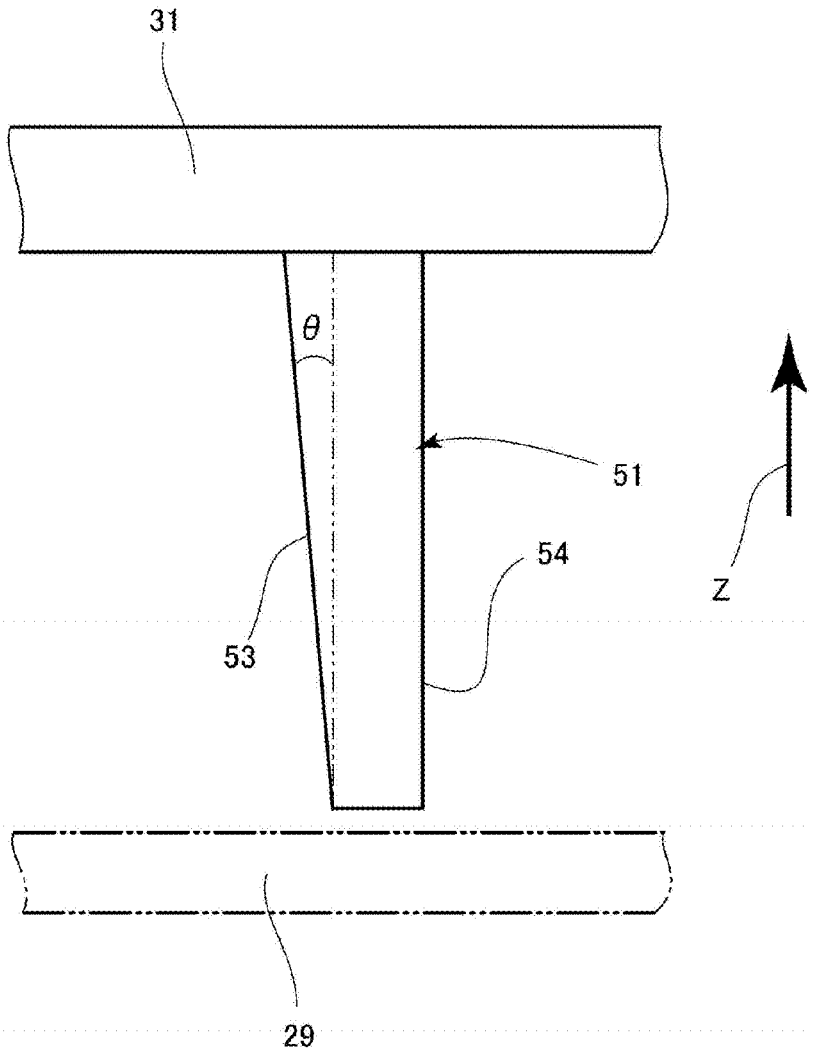
FIG. 8 is a view schematically illustrating a cross section of the blade.

FIG. 8 is a view schematically illustrating a cross section of the blade 51.

The cross section shown in FIG. 8 is a cross section which is perpendicular to a horizontal plane perpendicular to the rotation axis and is substantially perpendicular to the pressure surface 53 as seen in a bottom view. That is, the cross section shown in FIG. 8 corresponds to a cross section along the line C-C of FIG. 5. In FIG. 8, hatching is omitted. An arrow Z indicates a direction (upper side) parallel to the rotation axis of the impeller 30.

The pressure surface 53 is away from the negative pressure surface 54 in a direction of approaching the outer circumferential side of the blade 51 (the left side in FIG. 8) as it approaches the upper shroud 31. In other words, each blade 51 has the pressure surface 53 which is inclined to be tapered. Over the entire area of every blade 51 from the inner side to the outer side, a pressure surface 53 is formed in that tapered shape.

In FIG. 8, an angle θ represents the inclination, that is, a taper angle of the pressure surface 53 with respect to the rotation axis of the impeller 30. The taper angle θ is set to, for example, about 4° to 8°. In each blade 51, the negative pressure surface 54 is substantially parallel to the rotation axis in a cross section as shown in FIG. 8. That is, each negative pressure surface 54 is formed to become a plane perpendicular to a horizontal plane perpendicular to the rotation axis of the impeller 30. The lower end portion of each blade 51 is substantially horizontal (parallel to a plane perpendicular to the arrow Z of FIG. 8) in the cross section shown in FIG. 8. Therefore, each blade 51 has a trapezoidal shape in a cross section as shown in FIG. 8.

Since the blades 51 are formed as described above, the noise level can be reduced while securing a high static pressure, as compared to a case where the taper angle of every pressure surface 53 is 0° (that is, there is no taper angle). Also, in every blade 51, a taper angle as described above may not be set.

[Description of Step Portions of Blade 51]

In the present illustrative embodiment, in each blade 51, stepped portions 57 and 58 (examples of discontinuous portions) are formed at the pressure surface 53 and the negative pressure surface 54, respectively.

Figure 9:
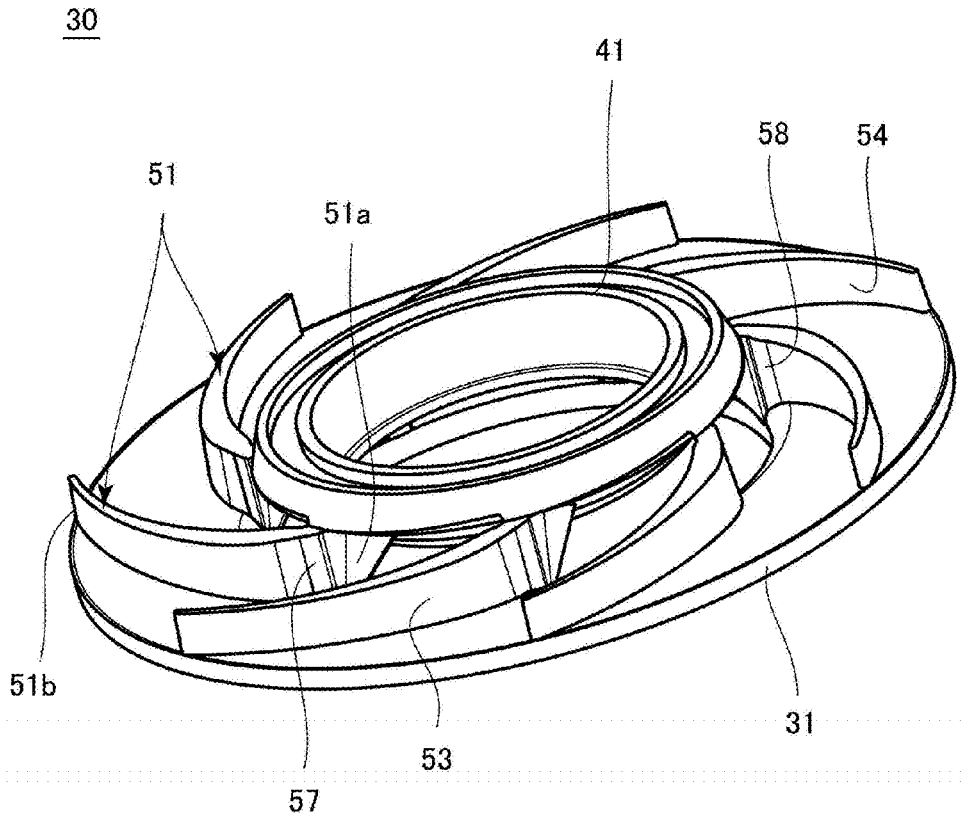
FIG. 9 is a perspective view illustrating a bottom side of the impeller.
Figure 10:
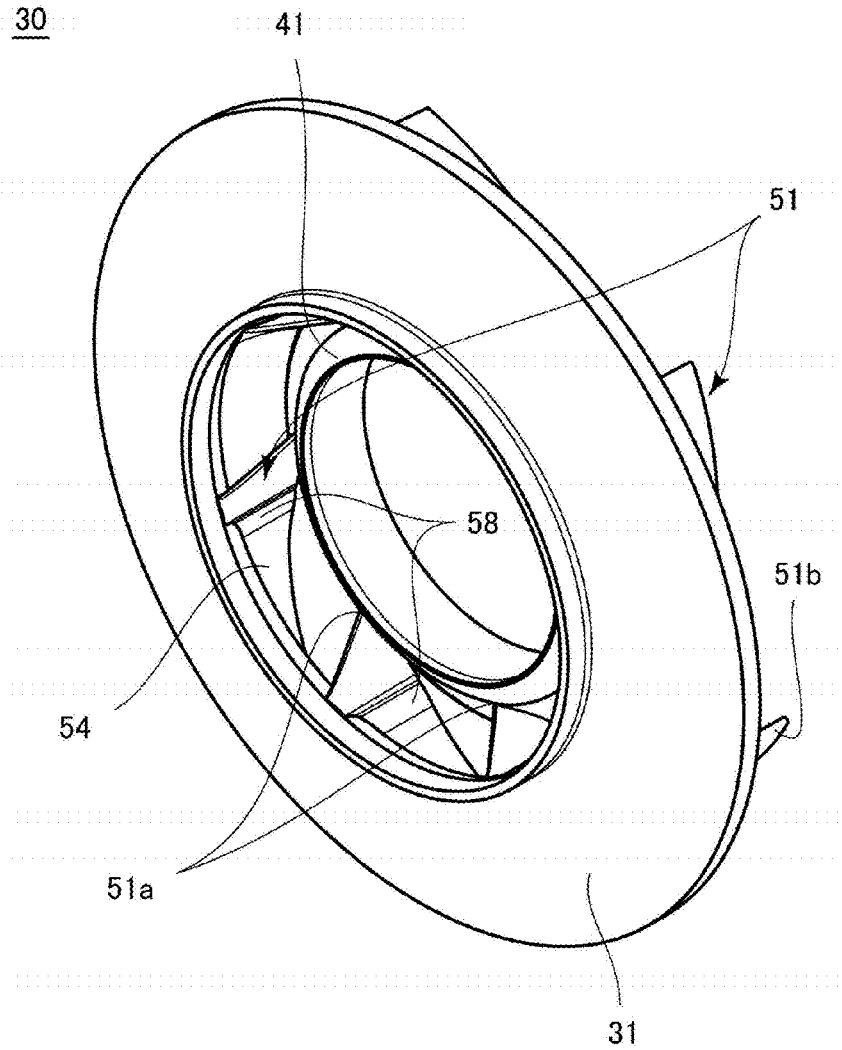
FIG. 10 is a perspective view illustrating a top side of the impeller.

FIG. 9 is a perspective view illustrating the bottom side of the impeller 30. FIG. 10 is a perspective view illustrating the top side of the impeller 30.

As shown in FIG. 9, the pressure surface 53 of each blade 51 is formed with a first stepped portion 57 at a side of the leading edge portion 51*a* of the corresponding blade 51. Also, as shown in FIG. 10, the negative pressure surface 54 is formed with a second stepped portion at the side of the leading edge portion 51*a*. That is, in the present illustrative embodiment, the pressure surface 53 and the negative pressure surface 54 each have a step shape of one step at the first stepped portion 57 and the second stepped portion 58. That is, the pressure surface 53 and the negative pressure surface 54 each have a shape which is partially not smooth or continuous (hereinafter, also referred to as a discontinuous shape) at the first stepped portion 57 and the second stepped portion 58.

Figure 11:
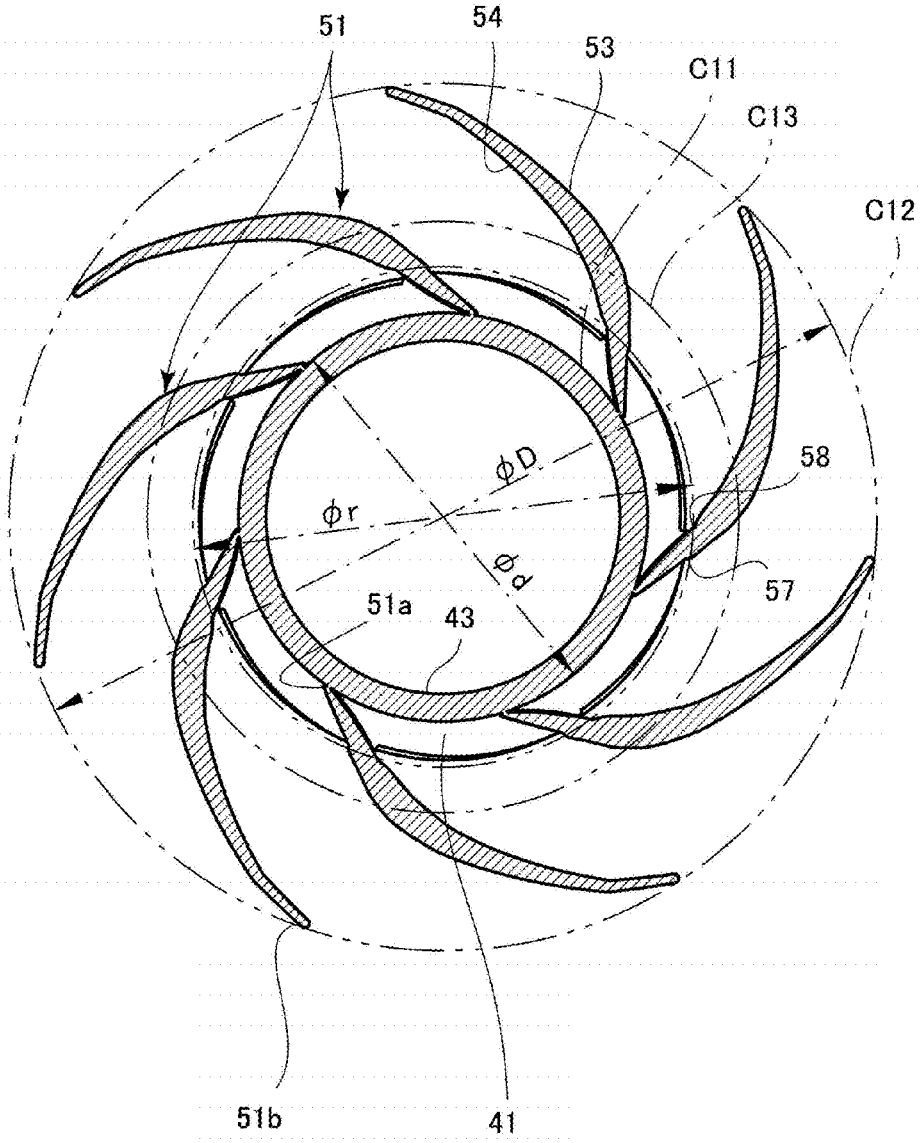
FIG. 11 is a cross-sectional view taken along the line G-G of FIG. 4.

FIG. 11 is a cross-sectional view taken along the line G-G of FIG. 4.

A cross section shown in FIG. 11 is a cross section in a plane which is perpendicular to the rotation axis of the impeller 30 and passes the leading edge portions 51*a* of the blades 51, that is, the contact points of the blades 51 with the lower shroud 41. As shown in FIG. 11, the first stepped portions 57 of the blades 51 are formed at positions which are the same in the distance from the rotation axis of the impeller 30. Similarly, the second stepped portions 58 of the blades 51 are also formed at positions which are the same in the distance from the rotation axis of the impeller 30.

In each blade 51, the first stepped portion 57 and the second stepped portion 58 are formed at positions included in a predetermined range close to the leading edge portion 51*a*. More specifically, the first step portion 57 and the second step portion 58 are formed at positions as follow. That is, the diameter of an inner circumferential circle C11 of the blades 51 passing the rotation axis of the impeller 30 through the leading edge portions 51*a* of the blades 51 is referred to as an inside blade diameter d. The diameter of an outer circumferential circle C12 of the blades 51 passing the rotation axis of the impeller 30 through the trailing edge portions 51*b* is referred to as an outside blade diameter D. In a cross section passing though the leading edge portions 51*a* shown in FIG. 11, the inner circumferential circle C11 and the outer circumferential circle C12 are substantially matched with the circle C4 and the circle C1 shown in FIG. 7, respectively.

In the present illustrative embodiment, with respect to each of the first stepped portion 57 and the second stepped portion 58, the diameter r (stepped position) of a circle having the rotation axis of the impeller 30 as its center and passing through the corresponding stepped portion is within a range represented by the following expression.

$$d<r<d+(D-d)\times 0.4$$

That is, each of the first stepped portion 57 and the second stepped portion 58 is positioned within a range extending in a radial direction perpendicular to the rotation axis between the leading edge portions 51*a* and a predetermined distance outward of the leading edge portions in the radial direction (a range which is on the inner side than a circle C13). Here, the predetermined distance is a distance which is 40% of a distance from the leading edge portion 51*a* to the trailing edge portion 51*b* in the radial direction of the impeller 30.

Figure 12:
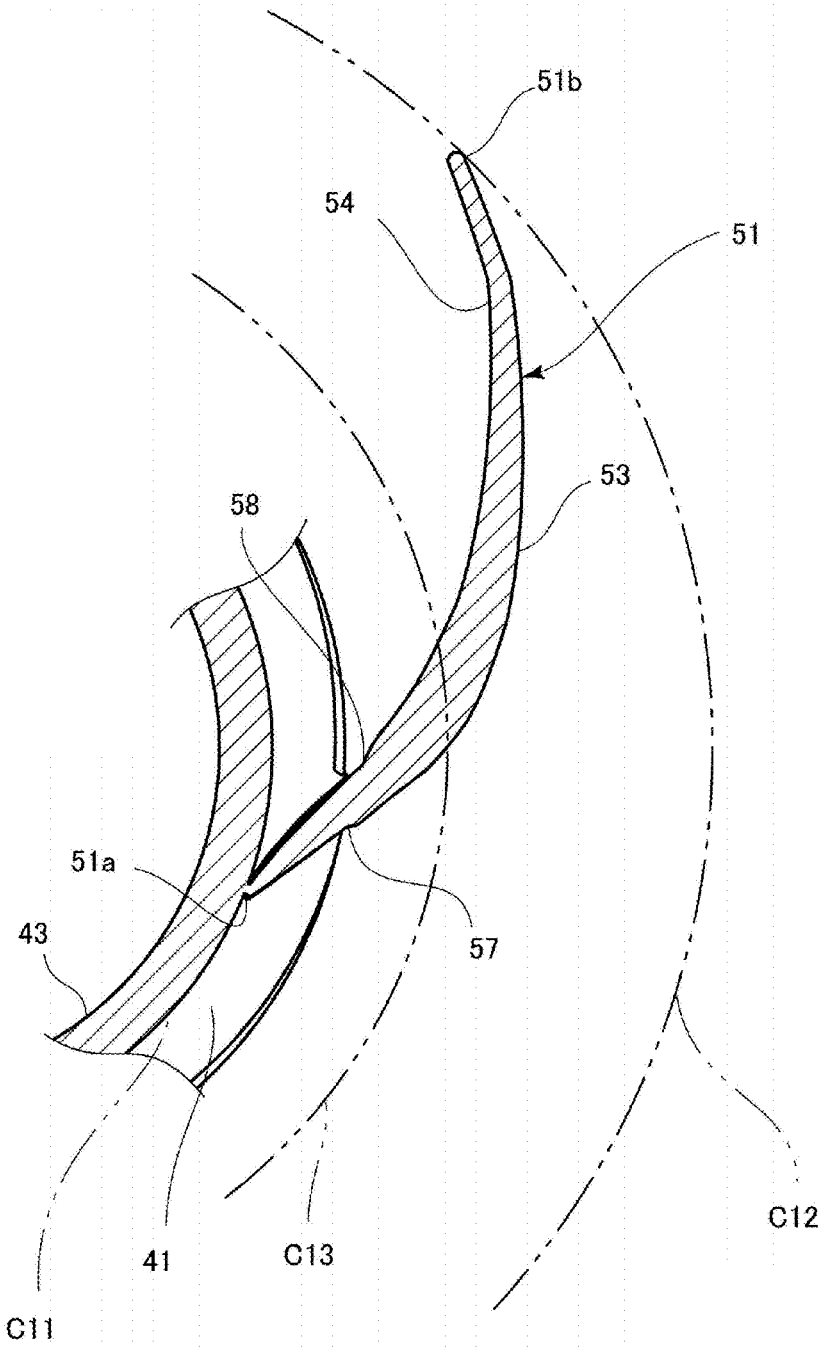
FIG. 12 is an enlarged view of a portion of FIG. 11.

FIG. 12 is an enlarged view of a portion of FIG. 11.

As shown in FIG. 12, the first stepped portion 57 and the second stepped portion 58 are formed such that in the shape of the blade 51, the thickness of the blade suddenly changes at those portions whereby stepped portions are formed at the pressure surface 53 and the negative pressure surface 54, respectively. In the present illustrative embodiment, stepped portions are formed such that, with each of the first stepped portion 57 and the second stepped portion 58 as a border, the thickness at a side of the trailing edge portion 51*b* becomes suddenly larger than the thickness at a side of the leading edge portion 51*a*.

Each of the first stepped portion 57 and the second stepped portion 58 is formed, for example, such that a step is formed along the rotation axis direction of the impeller 30. In other words, each of the first stepped portion 57 and the second stepped portion 58 is a step substantially parallel to the rotation axis of the impeller 30. Therefore, the impeller 30 can be formed comparatively easily. That is, a mold having a comparatively simple structure can be used as a mold for forming the impeller 30.

In the present illustrative embodiment, since the stepped portions 57 and 58 are formed as described above, during rotation of the impeller 30, generation of a vortex in each blade 51, which causes generation of noise and reduction of efficiency, can be reduced. That is, since the first stepped portions 57 and the second stepped portions 58 are formed, during an operation of the centrifugal fan 1, noise is reduced, and the efficiency is improved.

Figure 13:
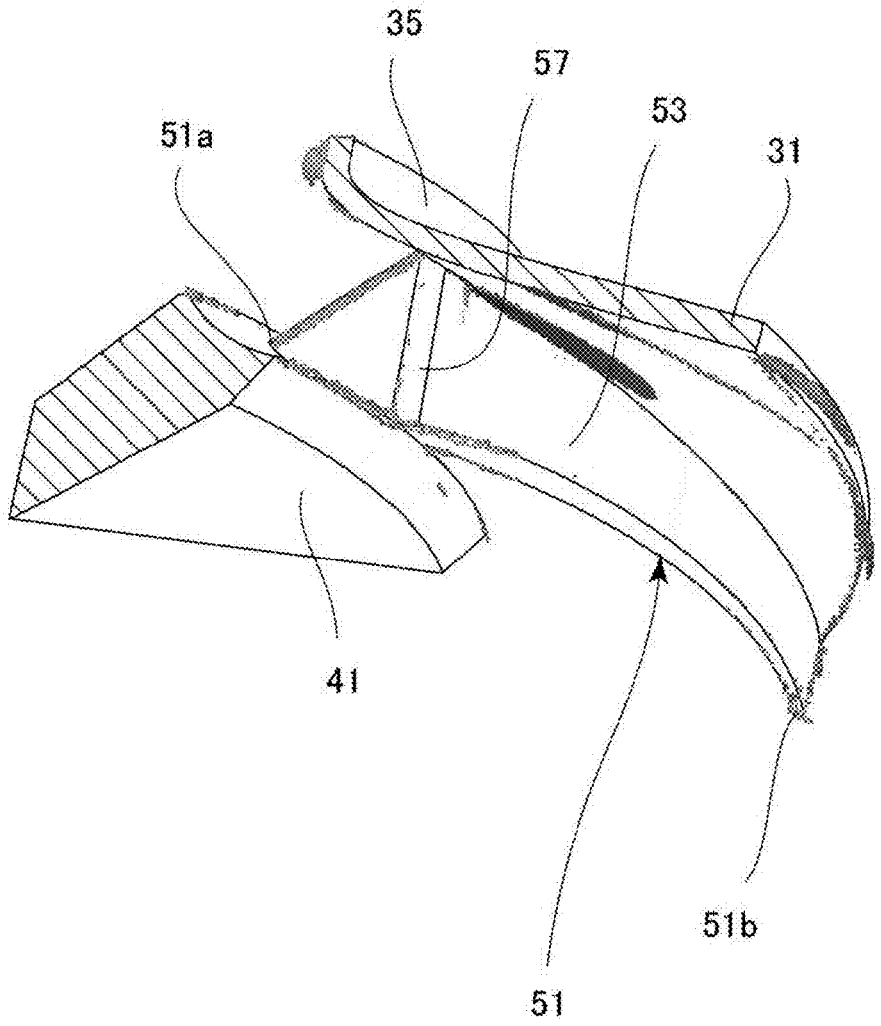
FIG. 13 is a view illustrating a vortex generation area on a pressure surface side during rotation of the impeller.
Figure 14:
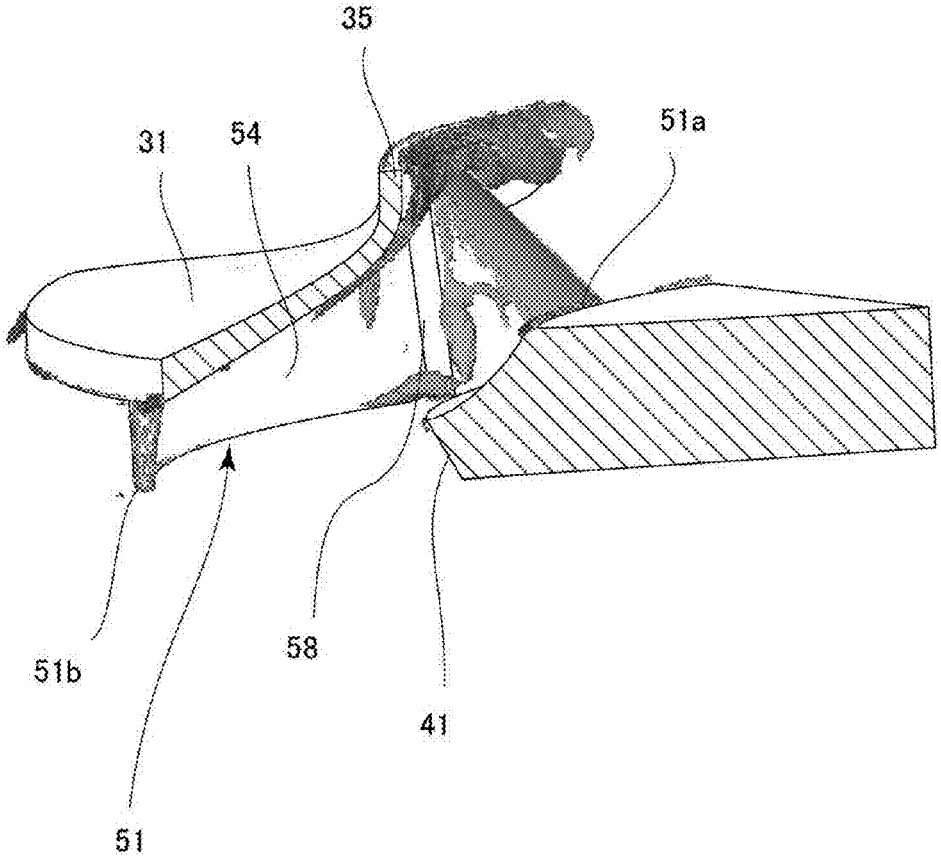
FIG. 14 is a view illustrating a vortex generation area on a negative pressure surface side during rotation of the impeller.
Figure 15:
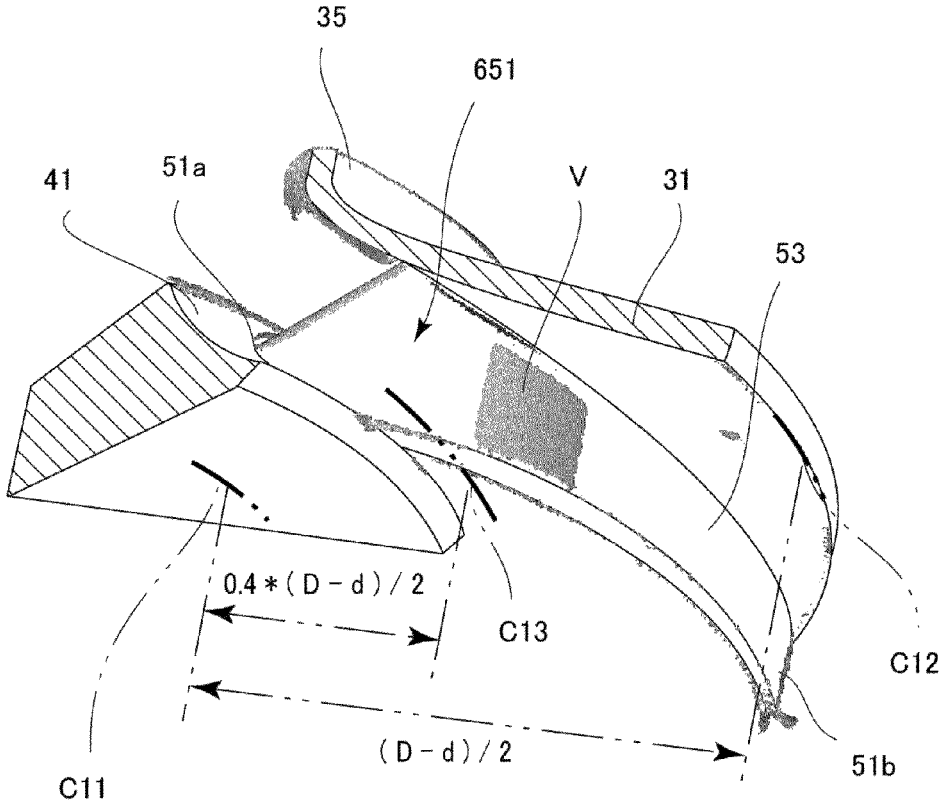
FIG. 15 is a view illustrating a vortex generation area on a pressure surface side in an impeller without step portions.
Figure 16:
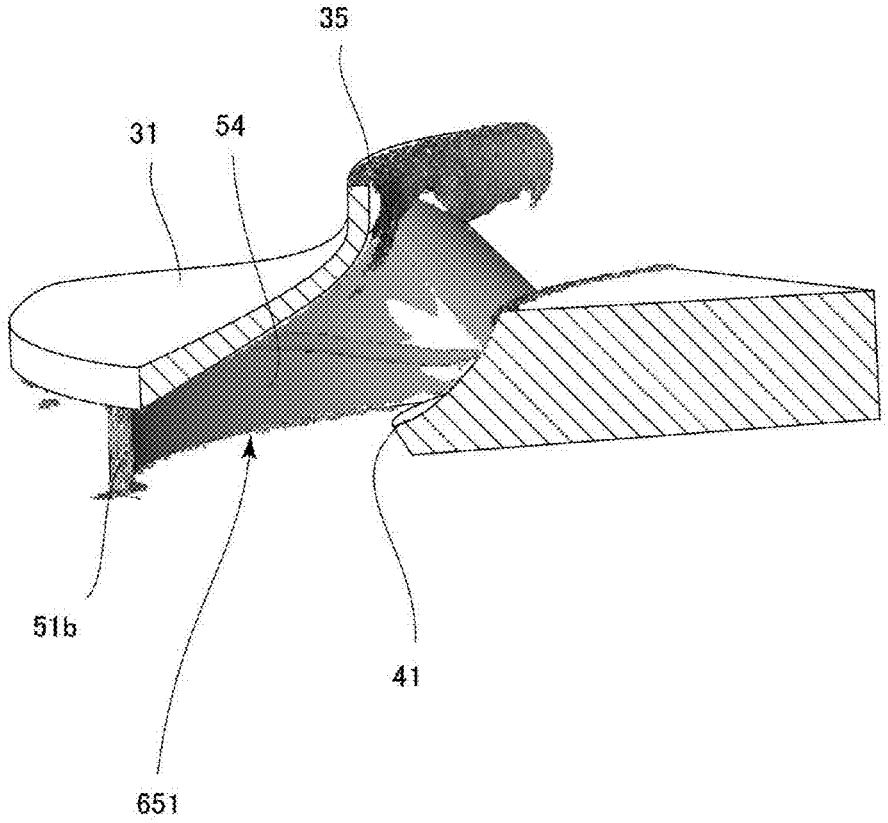
FIG. 16 is a view illustrating a vortex generation area on a negative pressure surface side in the impeller without step portions.

FIG. 13 is a view illustrating a vortex generation area on a side of the pressure surface 53 during rotation of the impeller 30. FIG. 14 is a view illustrating a vortex generation area on a side of the negative pressure surface 54 during rotation of the impeller 30. FIG. 15 is a view illustrating a vortex generation area on a side of the pressure surface 53 in an impeller without the stepped portions 57 and 58. FIG. 16 is a view illustrating a vortex generation area on a side of the negative pressure surface 54 in the impeller without the stepped portions 57 and 58.

In FIGS. 13 to 16, there are shown the results obtained by performing simulations, with respect to air vortexes which are generated around the impeller 30 in a case where blowing is performed by the impeller 30, under the same condition. In FIGS. 13 to 16, portions shown in gray represent generated vortexes. FIGS. 13 and 14 show the blades 51 with the stepped portions 57 and 58 according to the present illustrative embodiment. On the other hand, FIGS. 15 and 16 show blades 651 without the stepped portions 57 and 58, as a comparative example.

From comparison between FIG. 13 and FIG. 15, it can be appreciated that in the present illustrative embodiment, since the first stepped portions 57 are formed at the pressure surfaces 53, generation of vortexes is reduced, especially, on the downstream sides (sides close to the trailing edge portions 51*b*) of the first stepped portions 57, and separation of the flow of air is unlikely to occur. Similarly, from comparison between FIG. 14 and FIG. 16, it can be appreciated that since the second stepped portions 58 are formed at the negative pressure surfaces 54, generation of vortexes is reduced, especially, on the downstream sides of the second stepped portions 58.

Also, referring to FIG. 15, in a case where pressure surfaces 53 have no first stepped portions 57, at positions away from the leading edge portions 51*a* by more than 40% in the radial direction of the impeller 30 as seen in a bottom view, generation of vortexes can be seen (an area shown by a reference symbol "V" in FIG. 15). That is, in each pressure surface 53, in an area from an arc C13 to an arc C12 as seen in a bottom view, a vortex is likely to be generated. Therefore, if a first stepped portion 57 is formed within an area in front of the area from the arc C13 to the arc C12, that is, a range which is closer to the leading edge portion 51*a* than a position which is 40% of a direction from the leading edge portion 51*a* to the trailing edge portion 51*b* in the radial direction of the impeller 30 (a position shown by the arc C13) is, generation of vortexes can be efficiently reduced. Even in the negative pressure surface 54, since a vortex is likely to be generated in the same area, if a second stepped portion 58 is formed within a range which is closer to the leading edge portion 51*a* than the position which is 40% of the direction from the leading edge portion 51*a* to the trailing edge portion 51*b* in the radial direction of the impeller 30 is, generation of vortexes can be efficiently reduced.

Figure 17:
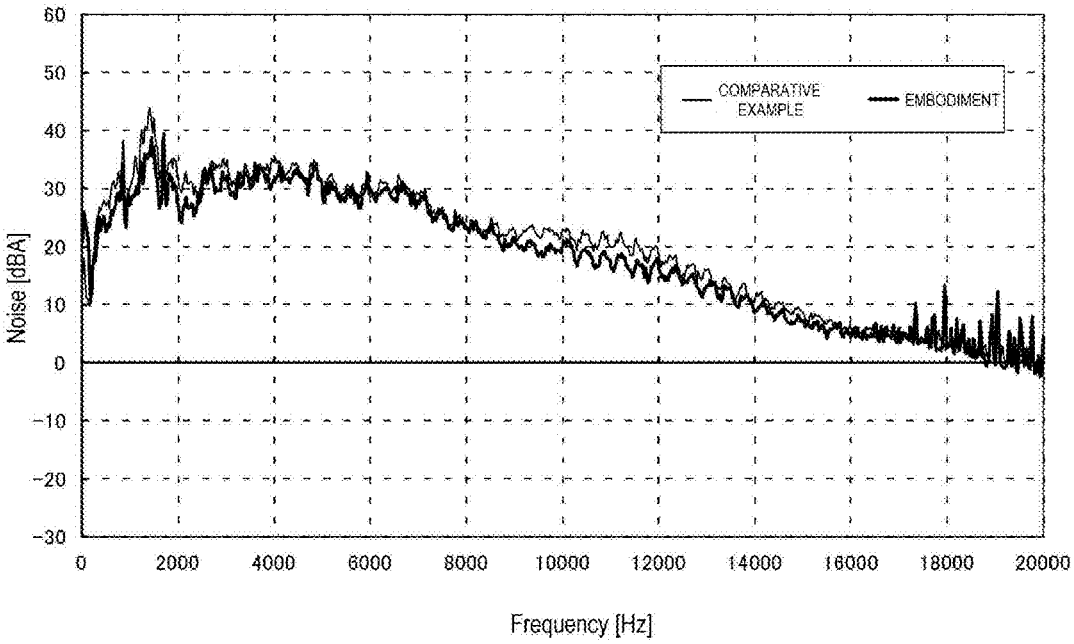
FIG. 17 is a graph illustrating a noise level of centrifugal fans.

FIG. 17 is a graph illustrating the level of noise of the centrifugal fan 1.

FIG. 17 shows the measured results of noise occurring during driving of the centrifugal fan 1 in comparison with the measured results of noise occurring during driving of a centrifugal fan without the stepped portions 57 and 58 (a comparative example). From the graph, it can be appreciated that in the centrifugal fan 1 according to the present illustrative embodiment, except for a frequency range in which the frequency is high, the noise level is lower than that of the comparative example in a wide frequency range which is normally used. Especially, a reduction in the noise level in a low-speed rotation range in which the noise level is comparatively high is remarkable. When overall values of noise character diagrams are compared, in the centrifugal fan 1, an effect of reducing the noise level by 1.2 dBA with respect to the comparative example is obtained.

Figure 18:
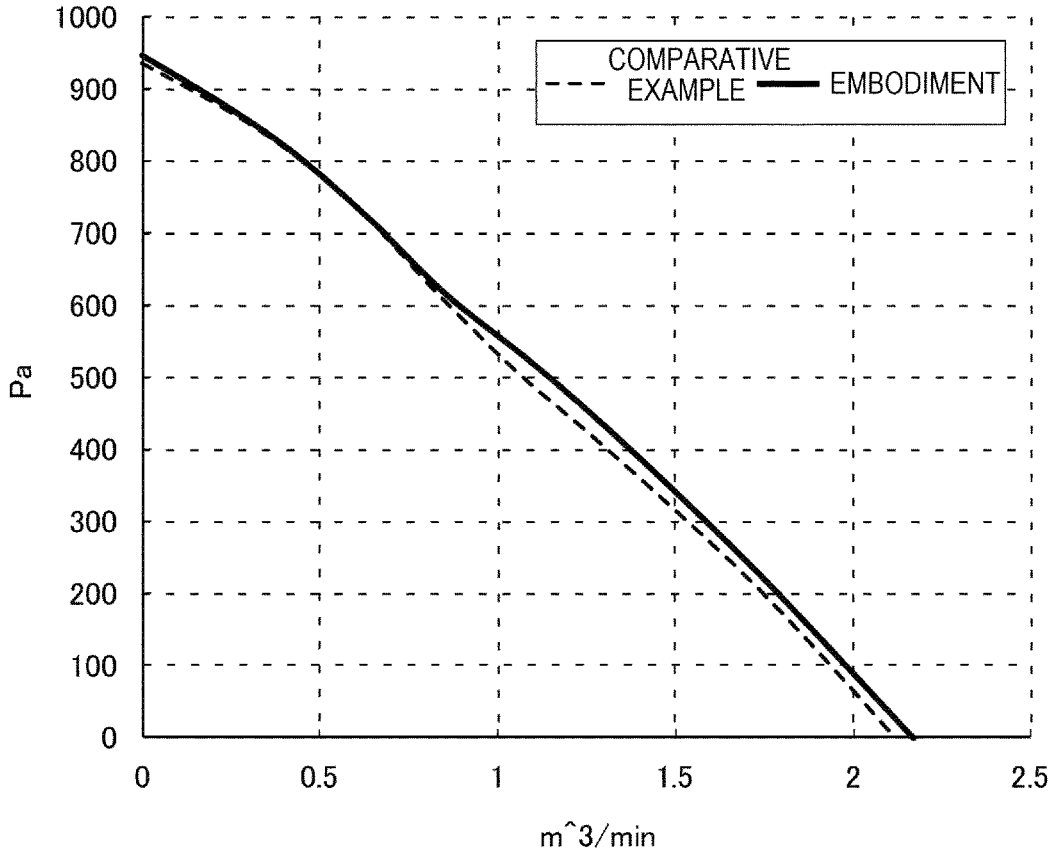
FIG. 18 is a diagram illustrating a P-Q curve of the centrifugal fans.

FIG. 18 is a diagram illustrating the P-Q curve of the centrifugal fan 1.

FIG. 18 shows the P-Q curve of each of the centrifugal fan 1 and the centrifugal fan without the stepped portions 57 and 58 (the comparative example). As can be seen from the graph, almost over the entire range from when the flow is maximum to when the static pressure is maximum, the centrifugal fan 1 according to the present illustrative embodiment has a characteristic better than that of the comparative example. That is, it can be said that the centrifugal fan 1 has higher efficiency.

As described above, in the present illustrative embodiment, at every blade 51 of the centrifugal fan 1, the stepped portions 57 and 58 are formed. As a result, the efficiency of the centrifugal fan 1 and reduce noise can be improved. Therefore, noise of a product using the centrifugal fan 1 can be reduced. This centrifugal fan 1 can be widely applied, especially, to products requiring suction cooling (for example, appliances, personal computers, office automation equipment, in-car devices, etc.).

The stepped portions 57 and 58 are disposed at positions capable of effectively suppressing vortexes from occurring around the blades 51 as described above. Therefore, the efficiency of the centrifugal fan 1 can be effectively improved.

In the centrifugal fan 1, for the pressure surface 53 of every blade 51, the taper angle is set such that the pressure surface 53 has a tapered shape. Since every pressure surface 53 is formed in a tapered shape, in the centrifugal fan 1 using the impeller 30, the maximum static pressure can be increased, and generation of noise can be suppressed. Therefore, the centrifugal fan 1 can be made thin, highly-efficient, and low-noise.

In each blade 51, the pressure surface 53 is configured by combination of three or more arcs as seen in a bottom view, or the curves of high-dimensional functions. Therefore, an efficient blade shape following the flow of air can be made, which has an effect of causing an increase in flow, an increase in static pressure, and a reduction in noise.

[Description of Modifications]

Also, instead of the step shape as in the first stepped portions 57 and second stepped portions 58, discontinuous portions having other step shapes such as grooves each of which is composed of a plurality of steps may be formed. Also, each discontinuous portion may be composed of a plurality of steps or grooves. These discontinuous portions may be formed on the side of the leading edge portion 51*a* of at least one of the pressure surface 53 and the negative pressure surface 54 of each blade 51. That is, since separation of the flow of a fluid is unlikely to occur on the surfaces having the discontinuous portions, the same effects as described above can be obtained.

The discontinuous portions may be formed such that the pressure surfaces 53 and the negative pressure surfaces 54 undulate along a direction parallel to the rotation axis of the impeller 30. Then, a mold for forming the impeller 30 can be made in a simple structure, and the impeller 30 can be easily formed. For example, the mold of two separate structures of a movable side and a fixed side can be employed.

Figure 19:
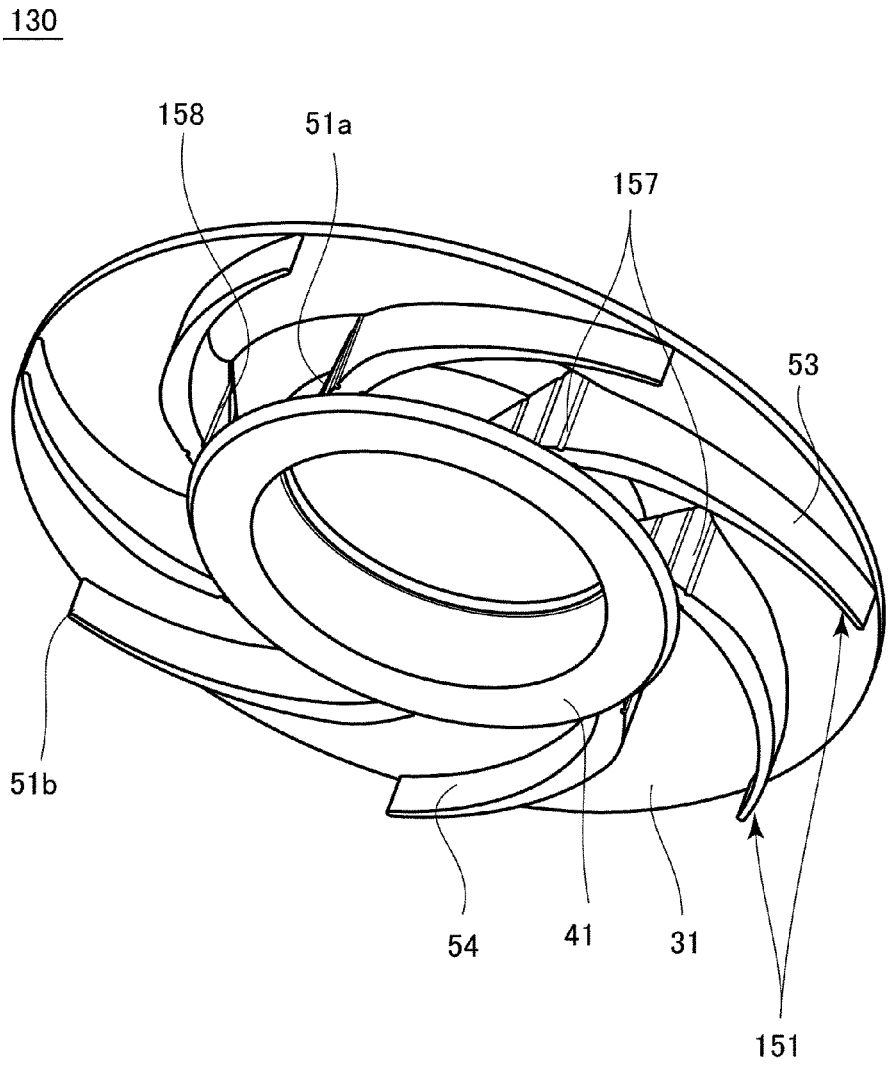
FIG. 19 is a perspective view illustrating an impeller of a centrifugal fan according to a first modification of the illustrative embodiment.
Figure 20:
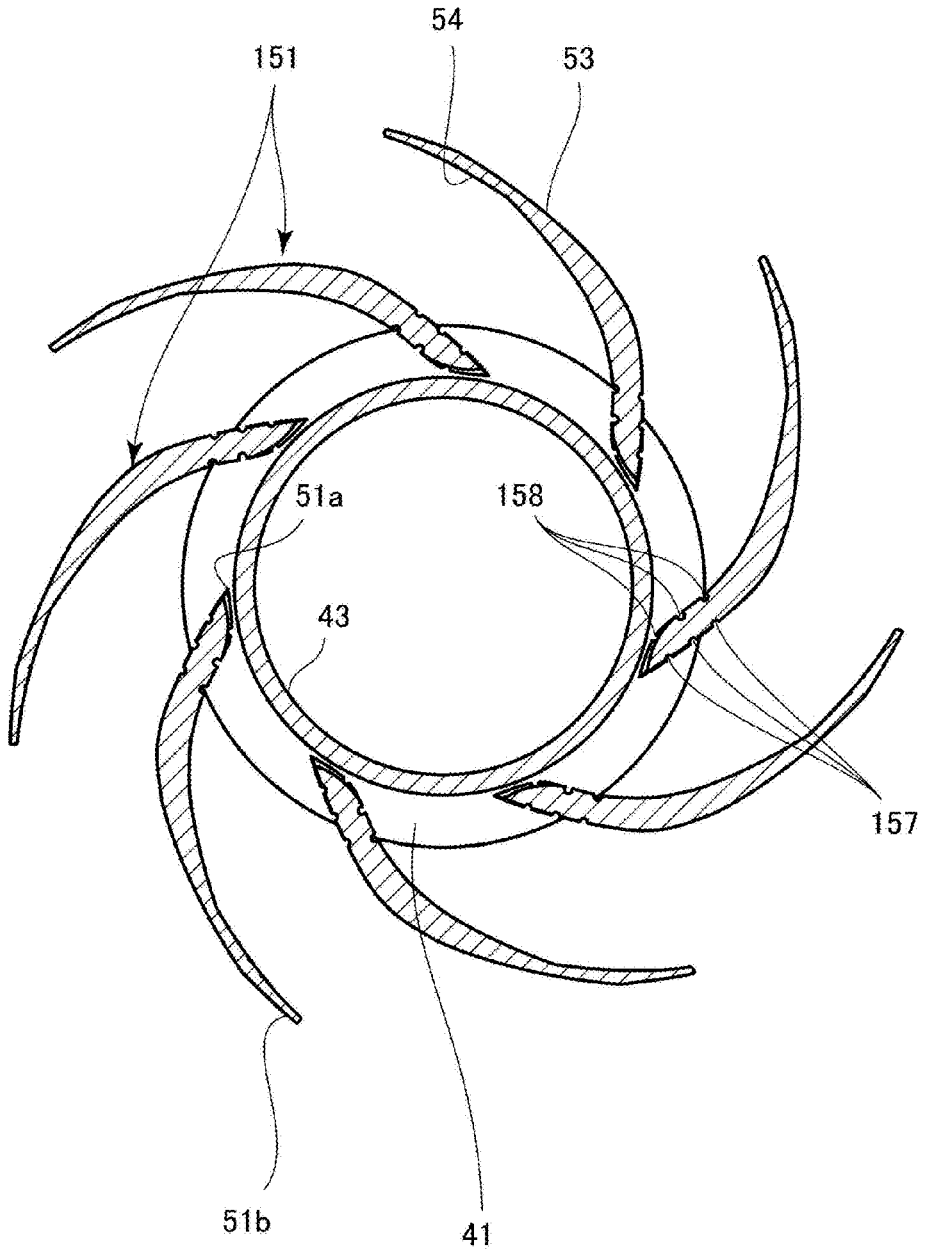
FIG. 20 is a view illustrating a blade shape of the impeller of the centrifugal fan according to the first modification.

FIG. 19 is a perspective view illustrating an impeller of a centrifugal fan 1 according to a first modification of the present illustrative embodiment. FIG. 20 is a view illustrating the blade shape of the impeller of the centrifugal fan 1 according to the first modification.

As shown in FIG. 19, the basic structure of an impeller 130 is the same as that of the above described impeller 30. In the impeller 130, instead of the blades 51 with the stepped portions 57 and 58, blades 151 having groove portions (examples of the discontinuous portions) 157 and 158 (first groove portions 157 and second groove portions 158) are provided.

FIG. 20 shows a cross section of the impeller 130 at the same plane as that of FIG. 11. As shown in FIG. 20, the groove portions 157 and 158 are formed at the pressure surfaces 53 and the negative pressure surfaces 54, respectively, and each includes three grooves. In the first modification, the grooves of each blade 151 are formed at substantially regular intervals from the vicinity of the leading edge portion 51*a* toward the trailing edge portion 51*b*. Since the groove portions 157 and 158 are formed, the pressure surfaces 53 and the negative pressure surfaces 54 become discontinuous.

Since the groove portions 157 and 158 are formed as described above, the same effects as described above can be obtained. That is, due to the action of the groove portions 157 and 158, separation of the flow of a fluid becomes unlikely to occur around the blades 151. Therefore, even in the centrifugal fan 1 having the above described impeller 130, high efficiency and low noise can be achieved.

Figure 21:
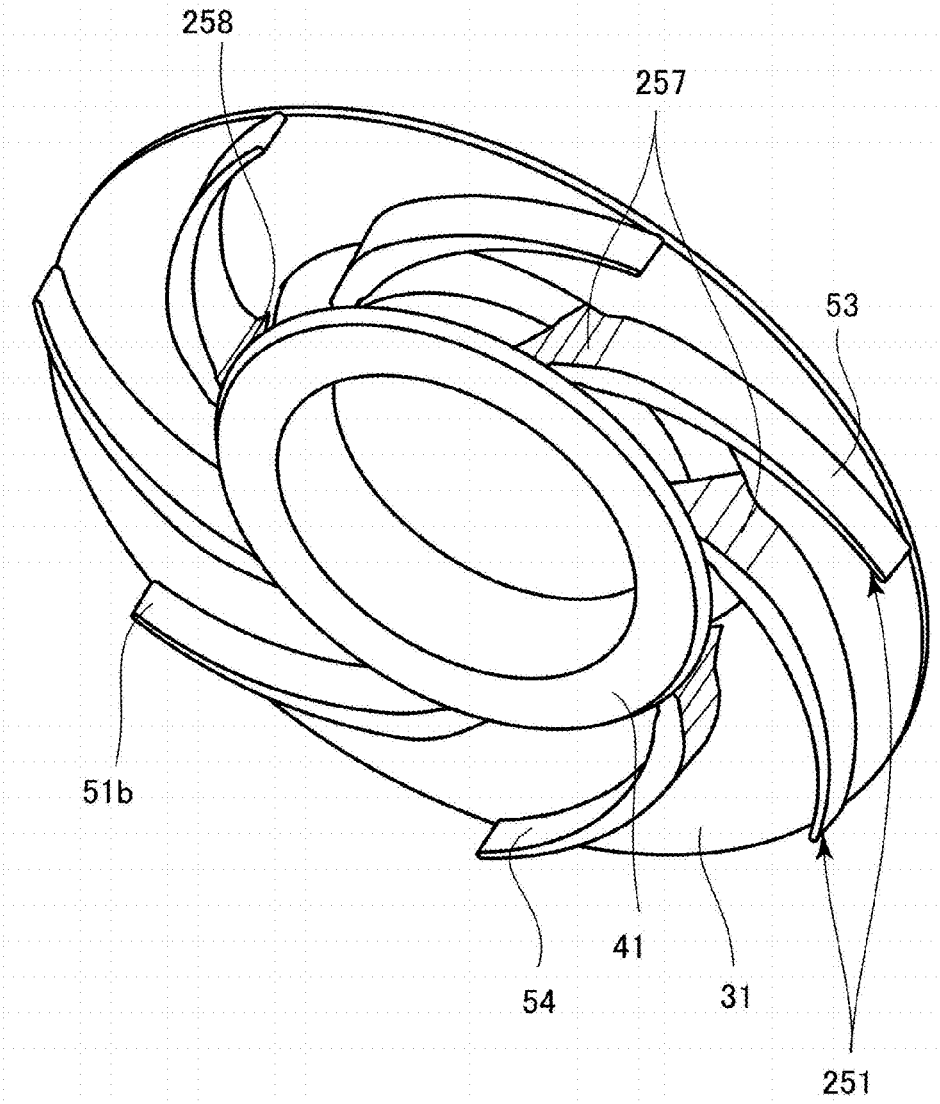
FIG. 21 is a perspective view illustrating an impeller of a centrifugal fan according to a second modification of the illustrative embodiment.
Figure 22:
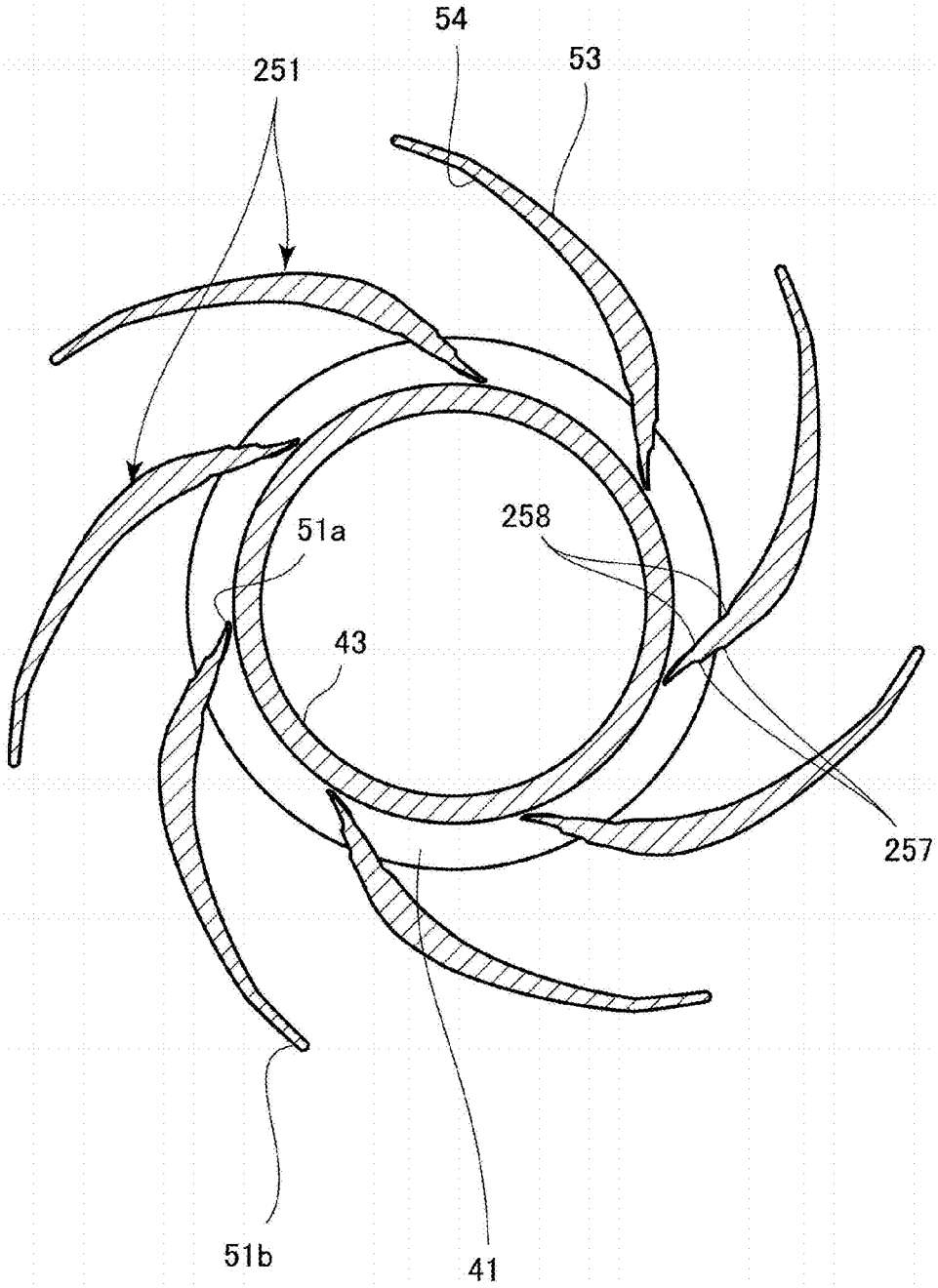
FIG. 22 is a view illustrating a blade shape of the impeller of the centrifugal fan according to the second modification.
Figure 23:
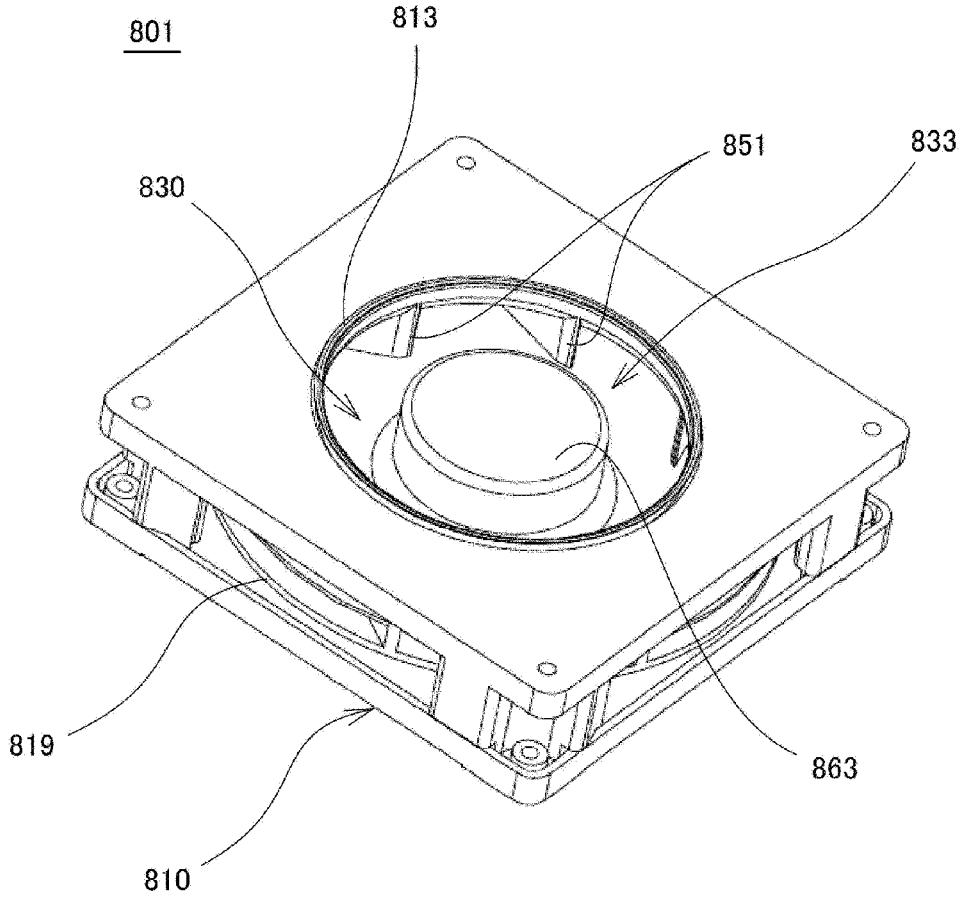
FIG.23 RELATED ART
FIG. 23 is a perspective view illustrating an example of a related-art centrifugal fan.
Figure 24:
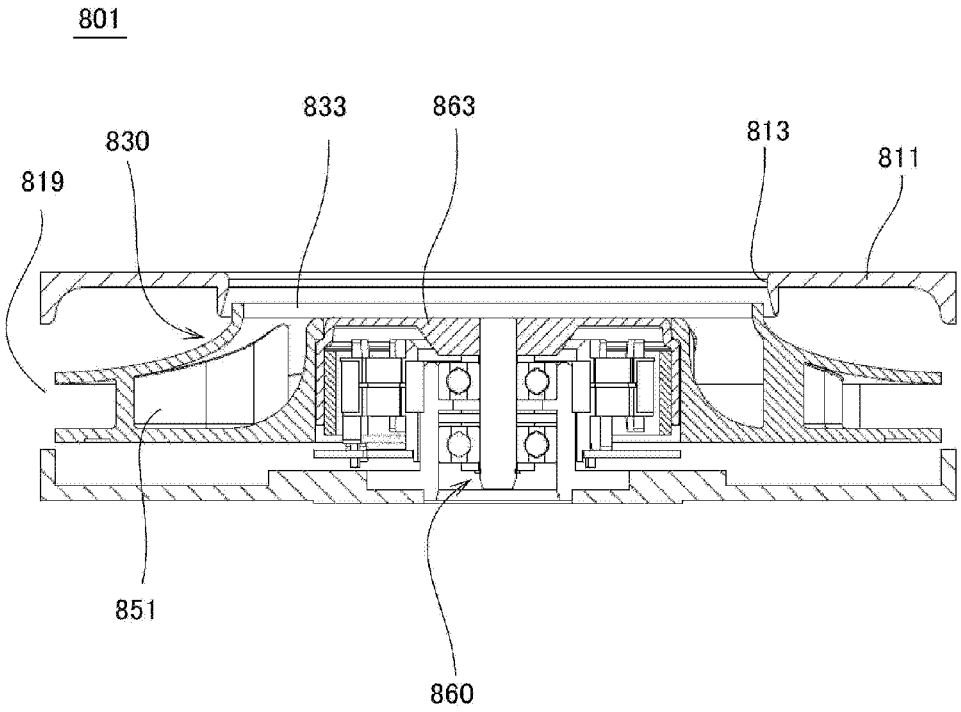
FIG.24 RELATED ART
FIG. 24 is a sectional side view illustrating the example of the related-art centrifugal fan.

FIG. 21 is a perspective view illustrating an impeller of a centrifugal fan 1 according to a second modification of the present illustrative embodiment. FIG. 22 is a view illustrating the blade shape of the impeller of the centrifugal fan 1 according to the second modification.

As shown in FIG. 21, the basic structure of an impeller 230 is the same as that of the above described impeller 30.

In the impeller 230, instead of the blades 51 having the stepped portions 57 and 58, blades 251 having stepped portions (examples of the discontinuous portions) 257 and 258 (first stepped portions 257 and second stepped portions 258) are provided.

FIG. 22 shows a cross section of the impeller 130 in the same plane as that of FIG. 11. As shown in FIG. 22, the stepped portions 257 and 258 are formed at the pressure surfaces 53 and the negative pressure surfaces 54, respectively, and each includes two steps. In the second modification, the steps of each blade 151 are formed such that the thickness of the corresponding blade 251 increases in a stepwise manner from the vicinity of the leading edge portion 51*a* toward the trailing edge portion 51*b*. Since the stepped portions 257 and 258 are formed, the pressure surfaces 53 and the negative pressure surfaces 54 become discontinuous.

Since the stepped portions 257 and 258 are formed as described above, the same effects as described above can be obtained. That is, due to the action of the stepped portions 257 and 258, separation of the flow of a fluid becomes unlikely to occur around the blades 151. Therefore, also in the centrifugal fan 1 having the above described impeller 230, high efficiency and low noise can be achieved.

Also, as described above, in each of the blades 51, 151, and 251, a pressure surface 53 is formed in a tapered shape, and in the first stepped portions 57 and 257 and the first groove portions 157, the steps and the grooves may be formed along the surfaces of the pressure surfaces 53. On the other hands, the first stepped portions 57 and 257, and the first groove portions 157 may be formed such that the heights of the steps or the depths of the grooves from the surfaces of the pressure surfaces 53 change along the rotation axis direction. Even in both cases, high efficiency and low noise of the centrifugal fan 1 can be obtained, and the impellers 30, 130, and 230 can be formed.

[Others]

The discontinuous portions such as the step portions and the groove portions do not necessarily need to be formed both sides of the pressure surface side and the negative pressure surface side. For example, the discontinuous portions may be formed only on the pressure surface side, or only on the negative pressure surface side.

The number of steps or grooves which are formed in each discontinuous portion is counted from the leading edge portion to the trailing edge portion, and may be one or more. Also, at each pressure surface or negative pressure surface, as a discontinuous portion, one or more steps and one or more groove portions may be formed side by side.

The blades are not limited to blades having pressure surfaces having a tapered shape. Each pressure surface may have a tapered shape only at a portion of an area from the inner side to outer side of each blade. Also, in the lower end portion (partition-portion-side portion) of each blade, the pressure surface may become substantially perpendicular to a horizontal plane, similarly to the negative pressure surfaces, and only a portion of the pressure surface close to the upper shroud may have a tapered shape. Also, only in some blades of the plurality of blades, each pressure surface may have a tapered shape.

The pressure surface of each blade is not limited to the tapered shape as linearly shown in a cross section as shown in FIG. 8 described above. For example, each pressure surface may be formed so as to approach a corresponding negative pressure surface as it approaches the partition portion, while being slightly curved in a cross section as described above.

The rough shape of the pressure surface of each blade as seen in a bottom view may not be a shape in which three arcs are connected as described above, and may not be a shape expressed by a combination of high-dimensional functions passing three points. The blades need only to be formed in an appropriate shape satisfying a desired condition.

The negative pressure surfaces may not be formed to be substantially perpendicular to a horizontal plane as described above. For example, the negative pressure surfaces may be slightly inclined, like the pressure surfaces.

The shape of the casing is not limited to a substantially square shape as seen in a plan view. The casing may have any arbitrary shapes such as a polygonal shape, a circular shape, and an asymmetric shape. The fastening portions of the upper casing and the lower casing are not limited to the insides of four corners of the upper casing as seen in a plan view. For example, at portions connected to protrude outward from the outer peripheral edge forming a substantially square shape as seen in a plan view of the upper casing, screws, supports, and the like for assembling the upper casing and the lower casing may be provided.

Also, in a case where supports are provided between the upper casing and the lower casing at the portions for fastening the upper casing and the lower casing, the shapes of the supports may be, for example, as follow. That is, the supports may have a substantially cylindrical shape having a size allowing screws for joining the upper casing and the lower casing to pass through. If supports having a shape as described above are used, air expelled from the impeller is expelled outward from the sides of the casing, with little or no resistance. Therefore, noise of a centrifugal fan can be reduced.

The lower casing may be formed by using materials such as a resin material other than a metal plate. The upper casing and the lower casing may be formed integrally.

It should be noted that the above-mentioned illustrative embodiment is merely illustrative in all aspects and are not to be construed as limiting the invention. The scope of the invention is defined by the appended claims rather than the detailed description of the invention. All changes or modifications or their equivalents made within the meanings and scope of the claims should be construed as falling within the scope of the invention.

What is claimed is:

1. A centrifugal fan comprising:

an impeller rotatable about a rotation axis; and a lower casing which is provided below the impeller, wherein the impeller includes an upper shroud having an upper portion formed with an inlet, a lower shroud, and a plurality of blades arranged along a circumference direction between the upper shroud and the lower shroud, and a fluid introduced from the inlet is discharged to a side of the impeller according to rotation of the impeller, wherein the blades extend from an inner side area to an outer side area in a radial direction, and the blades are only connected to the lower shroud with the inner side area of the blades such that at least an outer circumferential side portion of each blade faces an upper surface of the lower casing, wherein a surface of the lower casing, which faces the impeller, configures a portion of a wall surface which guides the fluid introduced from the inlet, wherein a surface of each blade is formed with a discontinuous portion having a step shape, the discontinuous portion being disposed closer to a leading edge portion of the blade than to a trailing edge portion of the blade, wherein each blade has a pressure surface and a negative pressure surface, the pressure surface being directed to a leading side of the impeller, the negative pressure surface being directed to a side opposite from the leading side to which the pressure surface is directed, wherein the pressure surface is inclined to be tapered toward the negative pressure surface at a constant taper angle, and wherein a distance between the pressure surface and the negative pressure surface is gradually decreased in a direction from the upper shroud to the lower casing.

2. The centrifugal fan according to claim 1, wherein the discontinuous portion is formed on at least one of the pressure surface and the negative pressure surface of each blade.

3. The centrifugal fan according to claim 1, wherein the step shape of the discontinuous portion is formed along a direction substantially parallel to the rotation axis.

4. The centrifugal fan according to claim 1, wherein the discontinuous portion includes at least one of one or more step shapes and one or more groove shapes.

5. The centrifugal fan according to claim 1, wherein the discontinuous portion is formed within a range extending in a radial direction perpendicular to the rotation axis between the leading edge portion and a predetermined distance outward of the leading edge portion in the radial direction, and wherein the predetermined distance is 40% of a distance from the leading edge portion to the trailing edge portion of each blade in the radial direction.

6. The centrifugal fan according to according to claim 1, wherein as seen from a direction in which the rotation axis of the impeller extends, the pressure surface of each blade has a shape in which at least three arcs are connected, or a shape expressed by a combination of a plurality of high-dimensional functions passing three points.

7. The centrifugal fan according to claim 1, further comprising:

a motor which is attached to the lower shroud and configured to rotate the impeller to introduce the fluid from the inlet and discharge the fluid to the side of the impeller.

8. The centrifugal fan according to claim 2, wherein the discontinuous portion is formed on both of the pressure surface and the negative pressure surface of each blade.

9. The centrifugal fan according to claim 8, wherein the discontinuous portion formed on each of the pressure surface and the negative pressure surface includes one or more step shapes or one or more groove shapes, wherein a number of the step shapes or the groove shapes formed on the pressure surface is equal to a number of the step shapes or the groove shapes formed on the negative pressure surface.

10. The centrifugal fan according to claim 1, wherein a height of the step shape of the discontinuous portion is constant along a direction parallel to the rotation axis.

11. The centrifugal fan according to claim 1, wherein a height of the step shape of the discontinuous portion changes along a direction parallel to the rotation axis.

12. The centrifugal fan according to claim 1, wherein an outer circumferential end portion of the lower shroud is positioned in a vicinity of an inner circumferential end portion of the upper shroud as viewed in a direction parallel to the rotation axis.

13. An impeller rotatable about a rotation axis, the impeller comprising:

an upper shroud having an upper portion formed with an inlet;

a lower shroud; and a plurality of blades arranged along a circumference direction between the upper shroud and the lower shroud, wherein the blades extend from an inner side area to an outer side area in a radial direction, and the blades are only connected to the lower shroud with the inner side area of the blades such that at least an outer circumferential side portion of each blade is exposed, wherein a surface of each blade at a side of a leading edge portion is formed with a discontinuous portion having a step shape, wherein each blade has a pressure surface and a negative pressure surface, the pressure surface is directed to a leading side of the impeller, the negative pressure surface being directed to a side opposite from the leading side to which the pressure surface is directed, wherein the pressure surface is inclined to be tapered toward the negative pressure surface at a constant taper angle, and wherein a first distance between the pressure surface and the negative pressure surface is gradually decreased as a second distance from the upper shroud in a direction parallel to the rotation axis of the impeller is increased.

14. The centrifugal fan according to claim 1, wherein the constant taper angle of the pressure surface with respect to the rotation axis of the impeller is set between 4 degrees and 8 degrees.

15. The impeller according to claim 13, wherein the constant taper angle of the pressure surface with respect to the rotation axis of the impeller is set between 4 degrees and 8 degrees.

* * * * *